US009908757B2

(12) United States Patent
Morrison

(10) Patent No.: US 9,908,757 B2
(45) **Date of Patent: *Mar. 6, 2018**

(54) GAS POWERED SELF CONTAINED PORTABLE WINCH

(71) Applicant: WIZARD PRODUCTS, LLC, Naples, FL (US)

(72) Inventor: Marc Andrew Morrison, Naples, FL (US)

(73) Assignee: WIZARD PRODUCTS, LLC, Naples, FL (US)

( * ) Notice: Subject to any disclaimer, the term of this patent is extended or adjusted under 35 U.S.C. 154(b) by 879 days.

This patent is subject to a terminal disclaimer.

(21) Appl. No.: 13/871,086

(22) Filed: Apr. 26, 2013

(65) Prior Publication Data

US 2014/0084229 A1 Mar. 27, 2014

Related U.S. Application Data

(63) Continuation-in-part of application No. 12/719,579, filed on Mar. 8, 2010, now Pat. No. 8,434,742.

(51) Int. Cl.

| | |
|---|---|
| ***B66D 3/20*** | (2006.01) |
| ***B66D 1/14*** | (2006.01) |
| ***B66D 1/22*** | (2006.01) |
| ***B66D 3/00*** | (2006.01) |
| ***B66D 3/26*** | (2006.01) |
| ***B66D 1/00*** | (2006.01) |

(52) U.S. Cl.

CPC ..... *B66D 3/20* (2013.01); *B66D 1/00* (2013.01); *B66D 1/14* (2013.01); *B66D 1/22* (2013.01); *B66D 3/006* (2013.01); *B66D 3/26* (2013.01)

(58) Field of Classification Search

CPC ... B66D 1/00; B66D 1/22; B66D 1/08; B66D 1/14; B66D 1/20

USPC ..... 254/342, 344, 345, 346, 348, 362, 365, 254/385

See application file for complete search history.

(56) References Cited

U.S. PATENT DOCUMENTS

| | | | | |
|---|---|---|---|---|
| 802,323 | A | 10/1905 | Roewe | |
| 1,353,238 | A | 9/1920 | Holmes | |
| 1,397,164 | A * | 11/1921 | Godfrey | 254/300 |
| 1,464,294 | A | 8/1923 | Reese | |
| 1,768,278 | A | 6/1930 | Whitaker, Jr. | |
| 1,898,987 | A * | 2/1933 | Hale | 254/302 |
| 1,931,655 | A | 10/1933 | Haseltine | |
| 2,038,149 | A * | 4/1936 | Walters | 74/665 H |
| 2,080,804 | A | 5/1937 | Brantly | |
| 2,151,338 | A | 3/1939 | Shonnard | |
| 2,159,250 | A | 5/1939 | Brantly | 254/358 |

(Continued)

*Primary Examiner* — Michael E Gallion

(74) *Attorney, Agent, or Firm* — Livingston Loeffler, P.A.; Bryan L. Loeffler, Esq.; Edward M. Livingston, Esq.

(57) ABSTRACT

A gas powered self-contained winch includes a combustion engine, a transmission assembly, a gear assembly and a clutch assembly connect to a spool capable of winding and unwinding a cable wire using forward and reverse drives. A hand controller communicates with the clutch assembly through a cable wire sufficient to control the winding and unwinding of the cable. Securing the winch for operation includes placing its center of gravity below the force line. A field changeable capstan option and remote control handle with throttle, power out lever, and kill switch are built in. A field installable hook float is provided for water rescue operations.

31 Claims, 23 Drawing Sheets

(56) References Cited

U.S. PATENT DOCUMENTS

| | | | | | |
|---|---|---|---|---|---|
| 2,178,280 | A | * | 10/1939 | Hutchins et al. | 254/281 |
| 2,278,022 | A | | 3/1942 | Rodgers | |
| 2,309,285 | A | | 1/1943 | Walton | |
| 2,417,199 | A | | 3/1947 | White | |
| 2,515,805 | A | | 7/1950 | Simmons | |
| 2,695,086 | A | * | 11/1954 | Parker | 477/9 |
| 2,869,822 | A | | 1/1959 | Shurtliff | |
| 3,036,435 | A | | 5/1962 | Samuely | |
| 3,051,447 | A | * | 8/1962 | Ahlbin | 254/347 |
| 3,220,701 | A | | 11/1965 | Clausen et al. | |
| 3,291,452 | A | | 12/1966 | Rau et al. | |
| 3,309,066 | A | * | 3/1967 | Carlson et al. | 254/268 |
| 3,322,398 | A | * | 5/1967 | Smith | 254/346 |
| 3,411,751 | A | | 11/1968 | Pooley, Jr. | |
| 3,572,482 | A | | 3/1971 | Kalpas et al. | 192/15 |
| 3,788,607 | A | | 1/1974 | Crooks | |
| 3,799,005 | A | * | 3/1974 | Koehler | 475/12 |
| 3,871,714 | A | | 3/1975 | Behrend | |
| 3,915,022 | A | * | 10/1975 | Walton | 74/99 R |
| 3,938,781 | A | | 2/1976 | Craven et al. | |
| 4,004,780 | A | * | 1/1977 | Kuzarov | 254/345 |
| 4,109,799 | A | | 8/1978 | Munn | |
| 4,145,028 | A | * | 3/1979 | Kelley et al. | 254/346 |
| 4,162,059 | A | * | 7/1979 | Fletchall | 254/358 |
| 4,169,580 | A | | 10/1979 | Hatlapa et al. | |
| 4,188,790 | A | | 2/1980 | Pedersen | |
| 4,196,889 | A | | 4/1980 | Dudek | 254/344 |
| 4,390,161 | A | * | 6/1983 | Nelson | 254/356 |
| 4,434,973 | A | | 3/1984 | Desplats | |
| 4,444,375 | A | | 4/1984 | Horn | |
| 4,552,340 | A | * | 11/1985 | Sheppard | 254/358 |
| 4,553,738 | A | * | 11/1985 | Plummer et al. | 254/358 |
| 4,569,423 | A | | 2/1986 | Hirano | |
| 4,588,167 | A | * | 5/1986 | Finzel | 254/346 |
| 4,613,273 | A | * | 9/1986 | Wagner | 414/463 |
| 4,623,124 | A | * | 11/1986 | Lewis | 254/350 |
| 4,635,903 | A | * | 1/1987 | Broyden et al. | 254/362 |
| 4,736,929 | A | | 4/1988 | McMorris | 254/344 |
| 4,830,300 | A | | 5/1989 | Taylor et al. | 242/390 |
| 4,846,309 | A | | 7/1989 | Nara et al. | |
| 4,930,719 | A | | 6/1990 | Sehl | |
| 4,974,814 | A | * | 12/1990 | Cundy | 254/345 |
| 5,002,259 | A | * | 3/1991 | Manning et al. | 254/350 |
| 5,020,737 | A | | 6/1991 | Sehl | |
| 5,072,962 | A | * | 12/1991 | Webb | 280/414.1 |
| 5,205,219 | A | | 4/1993 | Groskreutz et al. | |
| 5,249,777 | A | | 10/1993 | Herving | |
| 5,275,452 | A | | 1/1994 | Cleveland | |
| D348,758 | S | | 7/1994 | Lichtenvort | |
| 5,374,035 | A | | 12/1994 | Santos | 254/339 |
| 5,398,911 | A | * | 3/1995 | Holster | 254/267 |
| 5,398,923 | A | * | 3/1995 | Perry et al. | 254/375 |
| 5,411,122 | A | | 5/1995 | Uphaus | |
| 5,474,278 | A | * | 12/1995 | Cleveland | 254/334 |
| 5,544,862 | A | | 8/1996 | Hickerson | 254/124 |
| 5,573,091 | A | | 11/1996 | Hung | 192/12 R |
| 5,588,633 | A | | 12/1996 | McCrerie | |
| 5,603,489 | A | | 2/1997 | Regal | |
| 5,663,541 | A | | 9/1997 | McGregor, II | 200/17 R |
| 5,803,437 | A | * | 9/1998 | Paterson et al. | 254/343 |
| 5,899,441 | A | * | 5/1999 | Kuivamaki et al. | 254/366 |
| 5,970,813 | A | | 10/1999 | Parkins et al. | |
| 6,241,215 | B1 | | 6/2001 | Gersemsky et al. | 254/342 |
| D459,048 | S | | 6/2002 | Leemans | |
| 6,572,083 | B1 | | 6/2003 | Topping, Jr. et al. | |
| D482,174 | S | | 11/2003 | Xia et al. | |
| D482,507 | S | | 11/2003 | Xia et al. | |
| 6,663,086 | B2 | | 12/2003 | Huang | 254/344 |
| 6,820,863 | B2 | | 11/2004 | Rosati | |
| 6,845,589 | B1 | * | 1/2005 | Thompson et al. | 49/49 |
| 7,000,904 | B2 | | 2/2006 | Huang | 254/323 |
| 7,017,887 | B1 | * | 3/2006 | Verakis | 254/342 |
| D518,361 | S | * | 4/2006 | Jassenoff | D8/358 |
| 7,066,450 | B2 | | 6/2006 | Lundrigan | |
| 7,140,598 | B2 | | 11/2006 | Verakis et al. | |
| 7,222,700 | B2 | | 5/2007 | Elliott | |
| D546,022 | S | | 7/2007 | Elsen et al. | |
| 7,325,773 | B2 | | 2/2008 | Gorrie | |
| 7,448,597 | B2 | * | 11/2008 | Jacobson et al. | 254/274 |
| 7,469,881 | B2 | * | 12/2008 | Alipour et al. | 254/362 |
| 7,614,609 | B1 | | 11/2009 | Yang et al. | 254/344 |
| 7,648,125 | B1 | * | 1/2010 | Huang | 254/344 |
| 7,922,153 | B2 | * | 4/2011 | Zhou et al. | 254/344 |
| 8,079,569 | B2 | | 12/2011 | Lesko | 254/344 |
| 8,434,742 | B2 | * | 5/2013 | Akhavein et al. | 254/344 |
| 2003/0089897 | A1 | | 5/2003 | Hodge | 254/344 |
| 2003/0111654 | A1 | * | 6/2003 | Huang | 254/344 |
| 2007/0221898 | A1 | * | 9/2007 | Giacomini et al. | 254/323 |
| 2008/0157042 | A1 | | 7/2008 | Jacobson et al. | 254/270 |
| 2009/0114892 | A1 | | 5/2009 | Lesko | 254/342 |
| 2010/0065799 | A1 | * | 3/2010 | Zhou et al. | 254/344 |
| 2011/0215285 | A1 | * | 9/2011 | Akhavein et al. | 254/344 |
| 2012/0114508 | A1 | * | 5/2012 | Zheng | 417/313 |

* cited by examiner

GAS POWERED SELF CONTAINED PORTABLE WINCH

CROSS-REFERENCE TO RELATED APPLICATIONS

This application is a continuation-in-part of application Ser. No. 12/719,579, filed on Mar. 8, 2010, which is currently pending. The patent application identified above is incorporated herein by reference in its entirety to provide continuity of disclosure.

FIELD OF INVENTION

The invention is generally directed to a winch, and in particular to a self-contained and portable adjustable torque winch.

BACKGROUND OF THE INVENTION

A winch is typically a mechanical device used to pull in (or alternatively let out) a tensioned cable, wire, or cable. In its simplest form, a winch consists of a spool (that winds and unwinds) attached to a crank—which can either be hand or machine driven. Winches are often rigidly attached to an immobile object or heavy item such as a tow truck or steam shovel.

Winches have various applications, which are determined largely by their size and underlying design considerations. Many are used for recreational purposes, such as the towing of cars, boats or gliders. Others help retrieve recreational vehicles, such as pulling a boat onto a trailer. They are also used to accomplish the backstage mechanics necessary to move scenery in theatrical productions—such as to move large set pieces between performances. A new generation of winches have surfaced for use in snowboarding, wakeboarding and wakeskating designed to pull riders swiftly across a body of water or snow to simulate a riding experience normally supplied by a snow mobile, boat or wave runner.

Apart from recreation, winches also serve a very important role in the field of emergency rescue. Winches help remove debris and support recovery after various natural disasters such as floods, hurricanes, tornadoes, earthquakes and fires. This includes the lifting and removal of concrete partitions or other items which may have fallen on or trapped survivors of a natural disaster.

While various winches have been developed for purposes of emergency rescue, there exist numerous disadvantages and limitations in well known designs. For example, many winches today are add-on features to other motorized devices—typically chainsaws. One example of a chainsaw attachment is the "Lewis Winch." While the device boasts a 150-foot cable capable of pulling a load of 4,000 pounds, the device has several drawbacks. Most notably is the fact it requires a significant amount of time to assemble the Lewis Winch onto a chainsaw. In addition to assembly time, the operator must stand and hold the chainsaw throttle to operate the device, which can place the operator in a compromised and dangerous position.

While some all-in-one gas powered winches have been developed, these current systems also have multiple drawbacks—most notably their limited capacity due to design configuration. As one example, Chicago Power Tools, Inc. offers a winch that includes a 2.5 horse-powered four-stroke engine-which can pull a load of only 3,000 pounds. As a second example, Portable Winch Company offers a Honda® powered four-stroke engine that can pull 2,500 pounds at 60 feet per minute. Despite their larger engines both of the aforementioned examples suffer from relatively low load capacities and the fact that four-stroke engines must be kept upright to operate, which is often impossible in a rescue or off road situation.

One of the key issues in rescue and recovery after an emergency is not only the ability to move large objects to search for and recover survivors—but also how to return these bulky objects to a resting place without risking the lives of still trapped or isolated survivors. For example, once a fallen concrete and steel beam is lifted to release a trapped survivor, it is often necessary to gently lower that fallen beam at the scene after the trapped victim is removed. A controlled release of such an object is important to ensure that the beam is not uncontrollably dropped, which may risk the safety of others still trapped.

Current winch designs, including the three currently offered gas-powered winches discussed above, fail to allow for the controlled release of the cable tension and to allow a user to have sufficient control during release of the load. In addition, current winch designs fail to allow for a compact design which affords a durable transmission system that includes a clutch assembly capable of allowing controlled release of loads.

Accordingly, there is a need for an efficient gas powered compact all-in-one winch design that allows for controlled release of the cable, along with the ability to vary the torque, pulling rate and load capacity of winch.

SUMMARY OF THE INVENTION

The present invention solves many of the current design limitations found in conventional winch designs. In one embodiment, the winch first includes an external casing having a first side wall, a corresponding second side wall, a top wall, a bottom wall and a stabilizing bar. Located within the external casing is a two-stroke gas combustion engine, a transmission assembly, a gear assembly and a centrifugal clutch/brake assembly which in turn powers a spool. A pull-starter is used to initiate the engine.

One transmission assembly may include a main transmission drive (having a first end and corresponding second end), as well as a power drive (also having a first end and a second end). The first end of the power drive connects to the combustion engine. The power drive contains a first power drive gear proximate the first end and a second power drive gear proximate the second end, both of equal size. In contrast, the transmission drive has a first transmission gear and larger second transmission gear.

The transmission assembly is protected by a rigid transmission casing. Located on top of the transmission casing is a transmission knob connected to a cantilever via a shaft. By twisting the transmission knob, the cantilever rotates the shaft and toggles the transmission drive (moving it towards or away from the combustion engine). In one setting, the transmission drive engages the first transmission gear to rotate the transmission drive—providing a lower torque but a higher rate of rotation. In another setting, the transmission drive engages the second transmission gear—leading to a higher torque but slower rate of rotation for the transmission drive.

A gear assembly connects to the transmission drive regardless of the toggle setting caused by turning the transmission knob. The gear assembly includes at least one planetary gear and at least one threaded ring. Each planetary gear has a plurality of sub-gears (located between a first plate and a second plate) capable of fitting into a recess within each respective threaded ring and capable of receiving the second end of the transmission drive. By rotating the transmission drive, each sub-gear engages threads within the threaded ring providing stability and efficient rotation—which in turn provides rotational power to the clutch assembly. These components are maintained and protected through a first mounting plate and a corresponding second mounting plate.

A centrifugal clutch/brake assembly is connected to the transmission drive of the gear assembly. This assembly includes a first connecting gear which fits within a threaded clutch ring, which in turn can be engaged by a pivoting threaded arm member. A clutch cable connects with this threaded arm member, which is operated through a hand controller. By operating the hand controller, a user can apply pressure to the threaded arm member to pivot it onto the threaded clutch ring to control the rate of controlled release of the cable when under load. A clutch enclosure protects the various components of the clutch assembly and includes a rigid outer casing and a corresponding flat plate.

Moreover, the assembly serves as both a centrifugal clutch and a resistive break. The clutch includes shoes which engage a drum once the two-stroke engine reaches a predetermined speed. A drum housing coupled to the drum output plate contains a brake tab coupled to the input shaft of the transmission assembly. Each of these brake tables on the output plate ensures that the transmission input shaft will not rotate backwards. This in essence provides braking power necessary to hold tension on the cable when not retrieving line.

A spool located between the first side plate and second side plate connects with the gear assembly through at least one connecting gear emanating from the gear assembly. The spool winds and unwinds the cable. Located proximate the spool is a fairlead capable of directing and supporting the cable.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Exterior Components of the Winch

Figure 1:
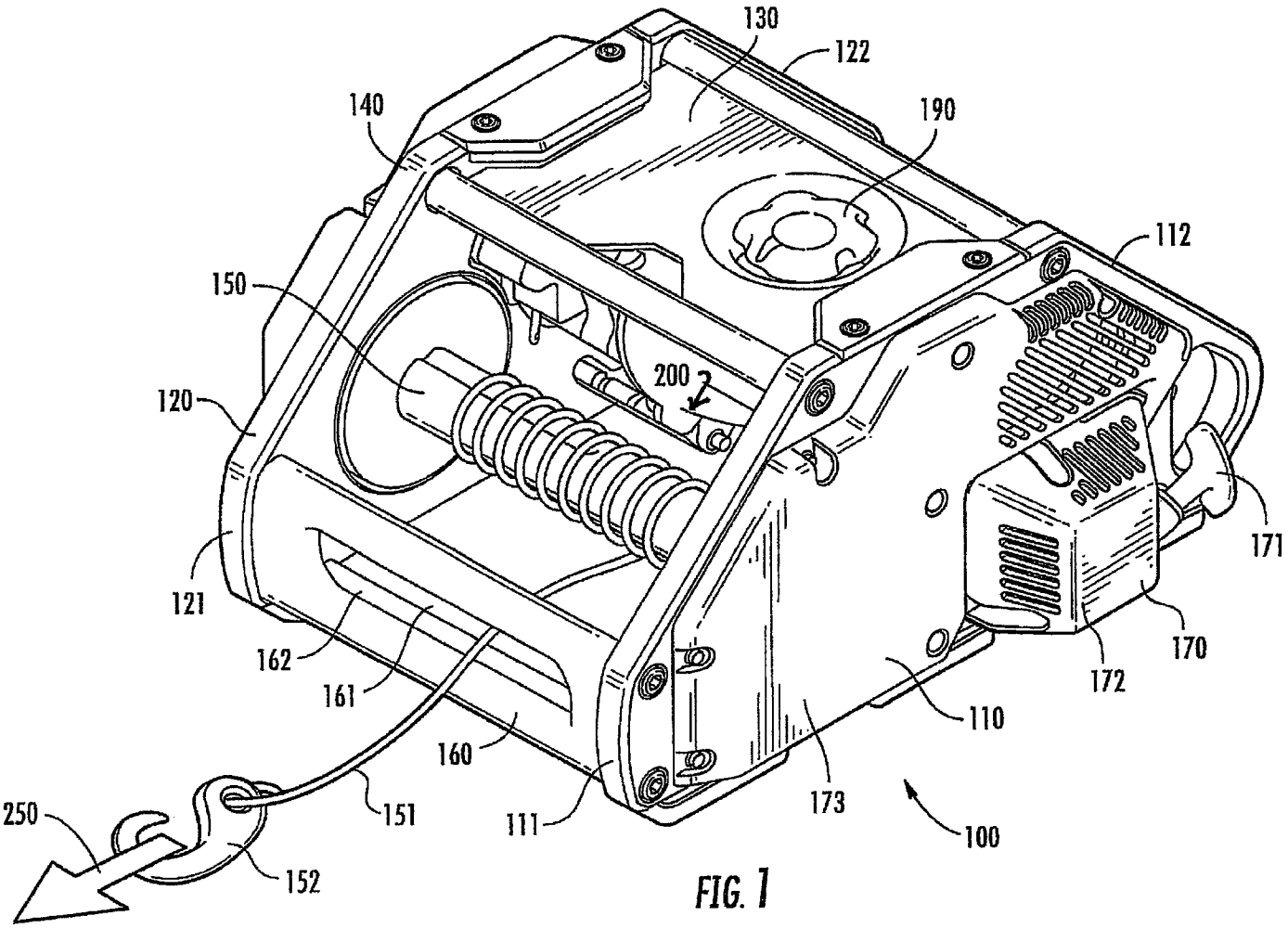
FIG. 1 is a front perspective view of one embodiment of a winch in keeping with the teachings of the present invention.
Figure 2A:
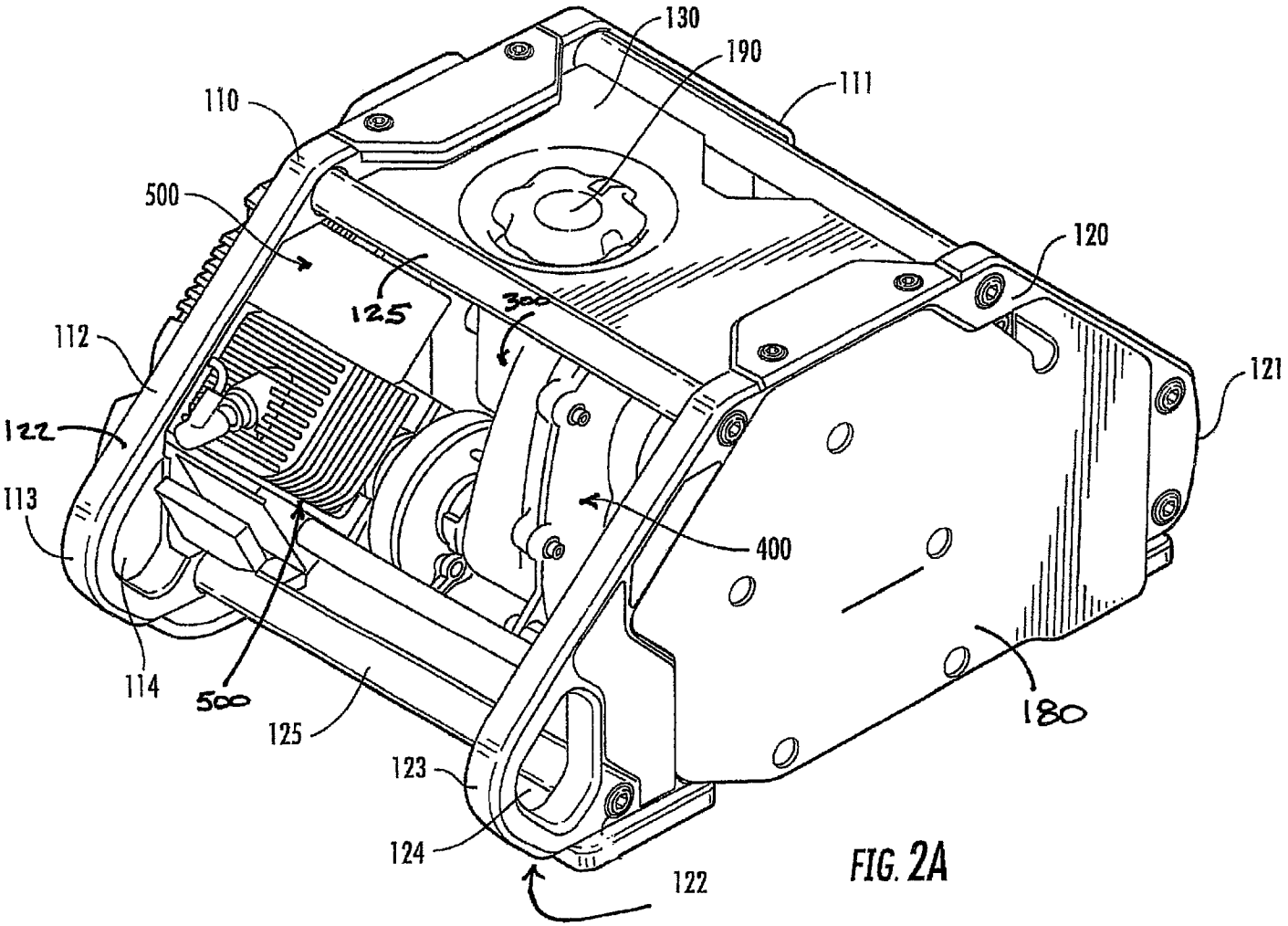
FIG. 2A is a right rear perspective view of the winch of FIG. 1.
Figure 2B:
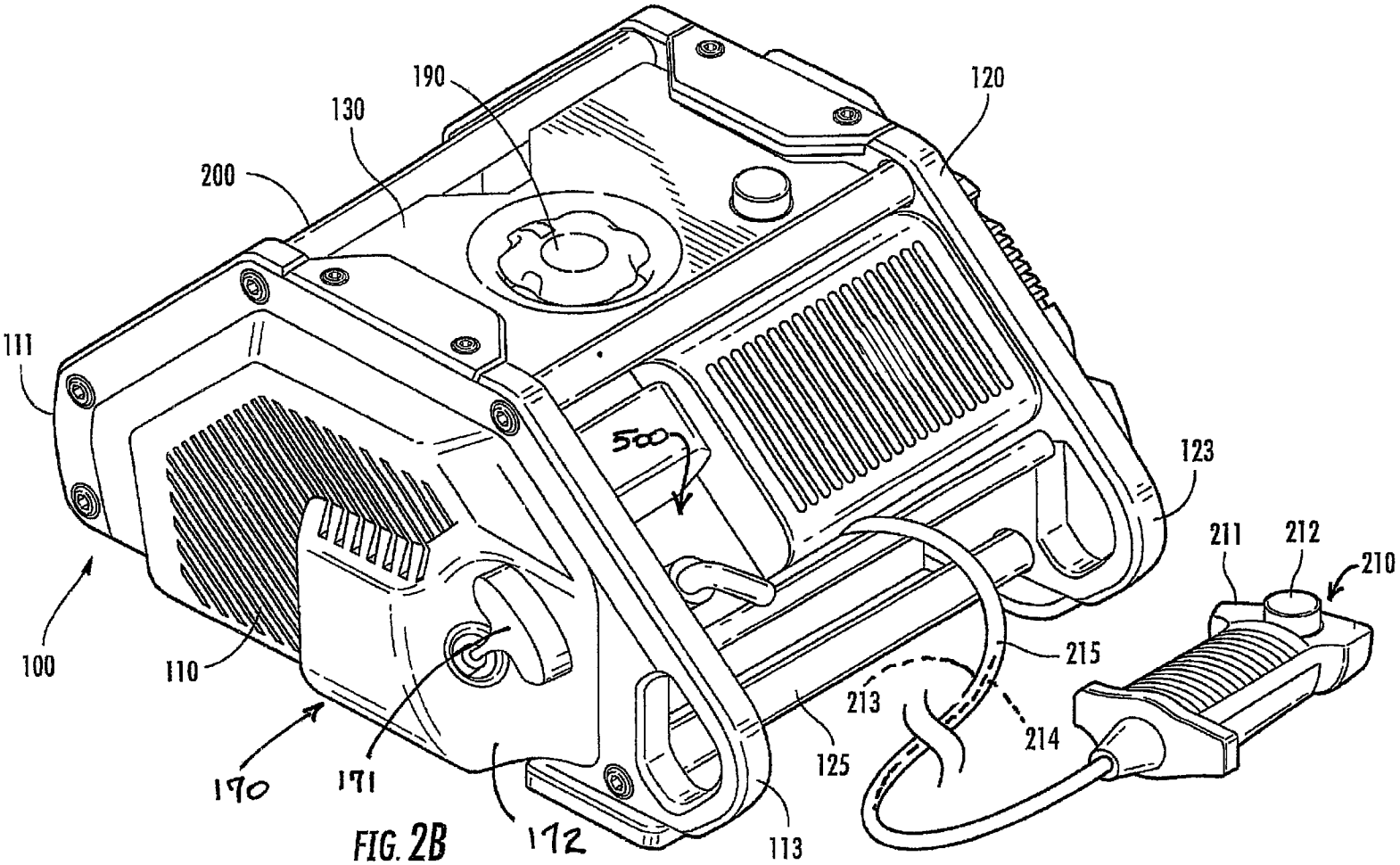
FIG. 2B is left rear perspective view of the winch including a hand held controller.

FIGS. 1, 2A and 2B offer various perspective views of an exterior casing of one embodiment of a winch 100. FIG. 1 provides a perspective front view of the winch 100. As shown, the winch 100 includes a first side wall 110 and a corresponding second side wall 120, generally parallel to the first side wall 110. The first side wall 110 is essentially flat and includes a front side 111 and a corresponding back side 112. Likewise, the second side wall 120 is essentially flat and includes a front side 121 and a corresponding back side 122.

Located between both side walls 110, 120 is a top wall 130. These three walls 110, 120, 130 help create a rigid and durable exterior casing 140 which helps protect and maintain various internal components 200 of the winch 100. While the exterior casing 140 is preferably made of high strength aluminum, other similar lightweight but strong materials known to those of ordinary skill in the art can be used.

With continued reference to FIG. 1, the first side wall 110 and the second side wall 120 maintain a spool 150 which houses, winds, unwinds, releases and retracts a high strength cable 151. The cable 151 (which can be any type of rope wire, or other similar high strength and tension device) is capable of connecting to a variety of connectors 152. The connectors 152 can include various hooks, latches and similar attachments. Located at the front sides 111, 121 of the side walls 110, 120 is a fairlead 160. The fairlead 160 includes a passage 161 and resting surface 162. The function of the fairlead 160 is two-fold. First, it creates an opening to allow the cable 151 to release and retract from the winch 100. Second, the resting surface 162 provides a strong structure where the cable 151 rests while it pulls, dislodges and moves various loads 250 during use.

Figure 5:
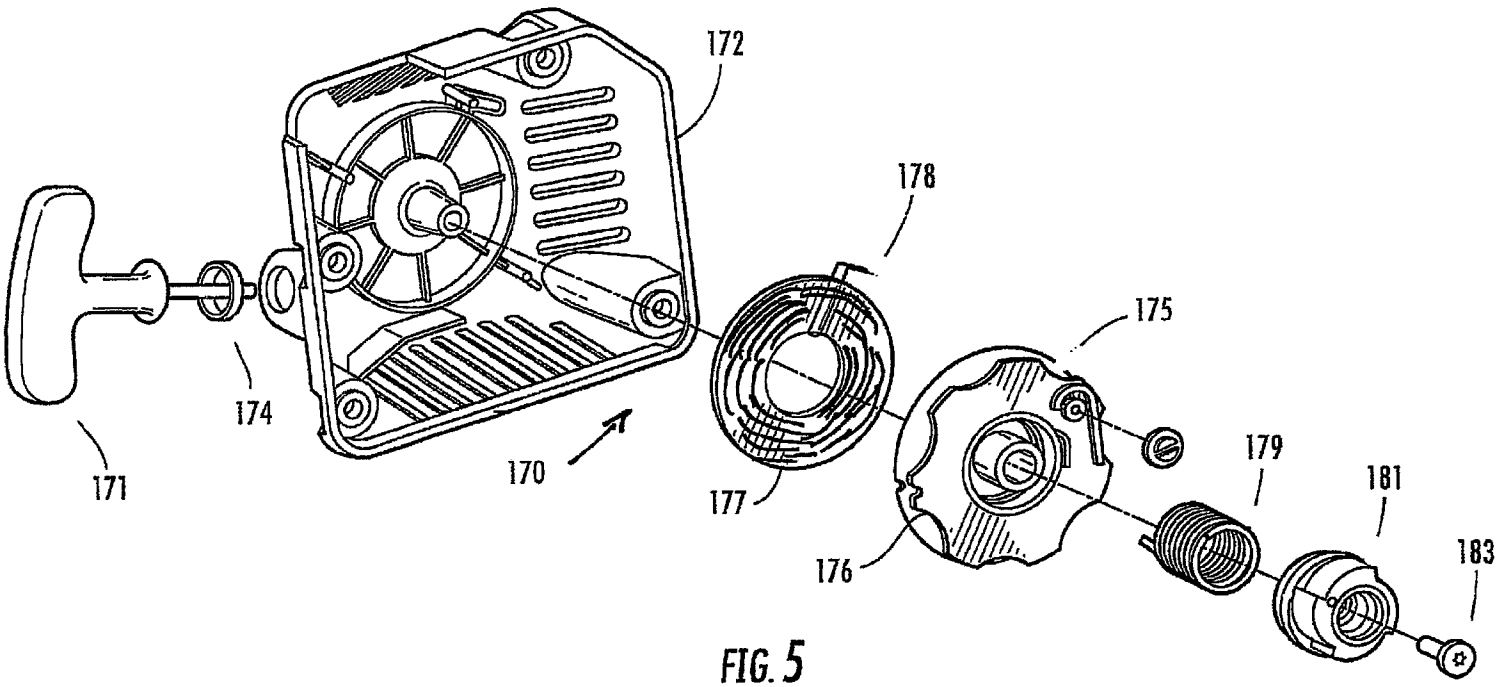
FIG. 5 is an exploded view of the various components of the pull-starter.

Also shown in FIG. 1 is a pull-starter 170, components of which are illustrated in FIG. 5. The pull-starter 170 includes a handle 171 that a user can pull to start a two-stroke gas powered combustion engine 500 (herein illustrated by way of example with reference to FIGS. 2A and 3 and described below). In addition, a hard casing 172 is located and placed over the pull-starter 170 to help protect its various moving parts.

While FIG. 1 offers a view of the front end of the winch 100, FIG. 2A provides a perspective view of a corresponding back end. Positioned proximate to both back sides 112, 122 of the side walls 110, 120 are two rigid attaching members 113, 123. The attaching members 113, 123 are in a parallel relationship to one another and include an attachment opening 114, 124 of sufficient size and dimension to allow a hook or other strong gripping device to cling to the winch 100. This in turn creates a sufficient stable anchor in which the winch 100 can operate and move loads during use. A stabilizing bar 125 positioned between the attaching members 113, 123 helps provide lateral support.

With continued reference to FIG. 2A, the second side wall 120 includes a secondary gear casing 180. This gear casing 180 helps protect the various moving gears that turn and power the spool 150, which in turn helps retract and release the cable 151 as described earlier with reference to FIG. 1. Located on the top side wall 130 is a transmission knob 190, described in greater detail below with reference to FIG. 3. The transmission knob 190 helps a user select a desirable setting regarding the amount of pulling capacity of the winch 100 as well as rate of acceleration of the cable 151.

FIG. 2B is another perspective view of the winch 100. As shown in this view, the winch 100 includes a hand controller 210. The hand controller 210 acts as a throttle and slip clutch to help regulate not only the retrieval of the cable 151 but also its steady release. The hand controller 210 includes a pivoting trigger member 211 and a rotatable rate control instrument 212.

Attached to the hand controller 210 are two independent control cables 213, 214 which are encased in a controller tubing 215. The first control cable 213 is connected to the pivoting trigger member 211 for controlling the rate of acceleration of the cable 151 when moving the loads 250. The second control cable 214 is connected to the rotatable rate instrument 212 for regulating the rate of release of the cable 151. The control cables are connected to the two-stroke gas powered engine 500 and clutch assembly 404, illustrated with reference to FIGS. 3, 4, 12 and 13 and discussed in greater detail below.

Interior Components of the Winch

Figure 3:
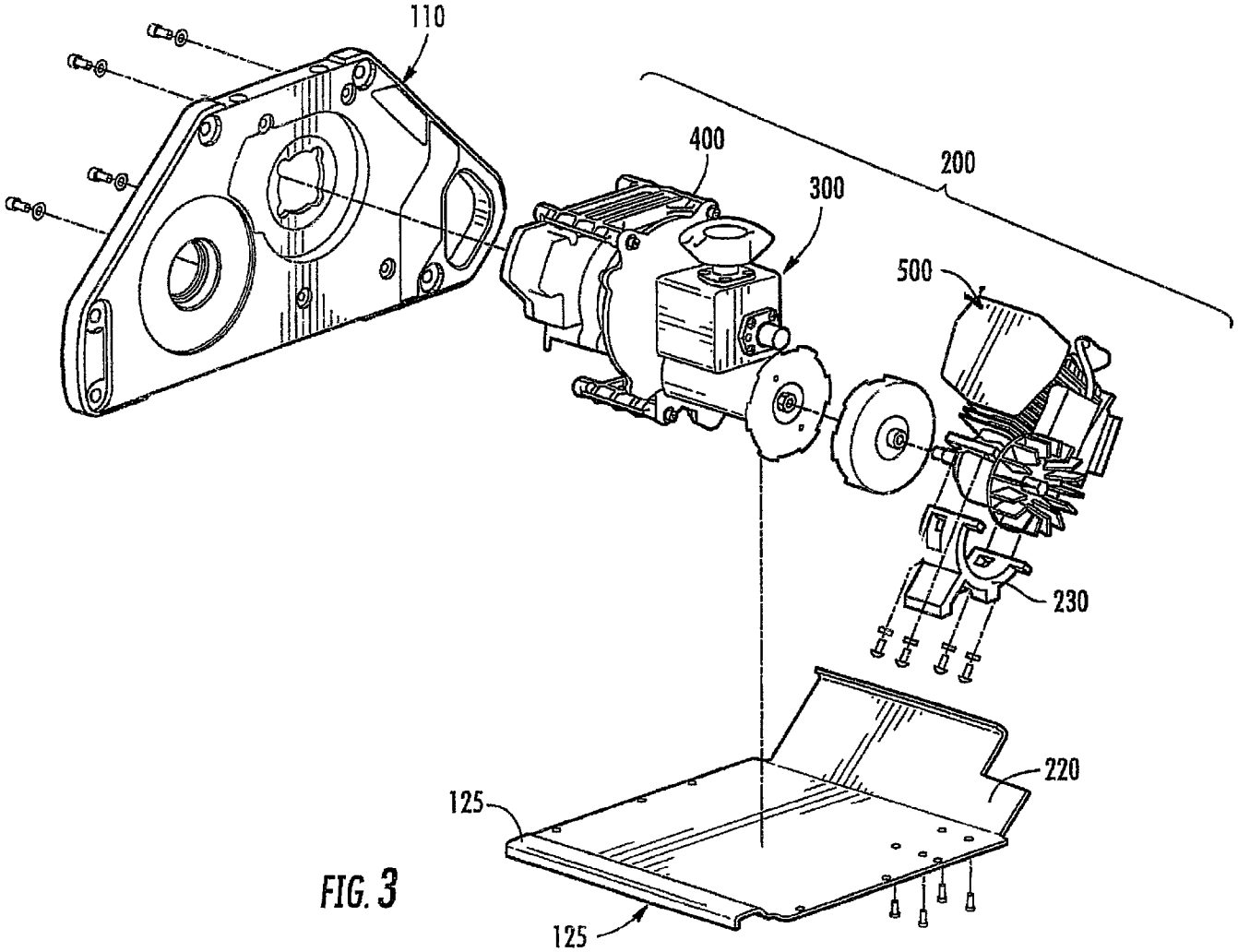
FIG. 3 is an exploded view of the various internal components of the winch including the transmission assembly, the gear assembly and two-stroke combustion engine.
Figure 4:
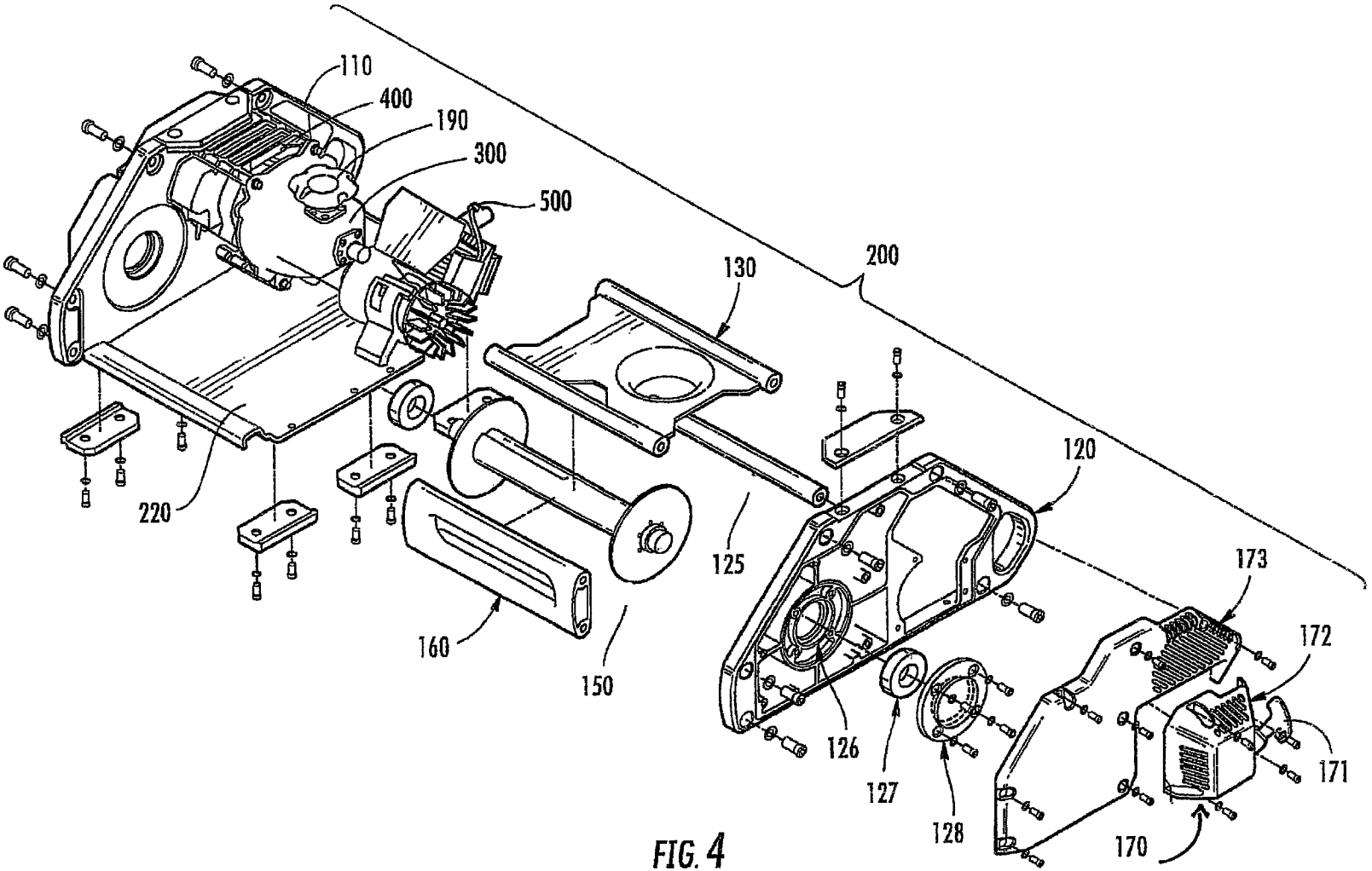
FIG. 4 is another exploded view of spool and fairlead.

FIGS. 3 and 4 illustrate the various interior components 200 of the winch 100. These interior components 200 are located between the first side and second side walls 110, 120 earlier described with reference to FIGS. 1 and 2A. As further illustrated with reference to FIG. 3, these interior components 200 include a transmission assembly 300 operable with a gear assembly 400 and a two-stroke gas powered combustion engine 500. A rigid bottom plate 220 provides a portion of the winch enclosure. The bottom plate 220 can optionally include the stabilizing bar 125, as described above with reference to FIG. 2A. The bottom plate 220 prevents debris from entering into the various components 300, 400, 500 and acts as a collection basin for any gas or oil residue from these components. A motor mount 230 secures the engine 500 to the bottom plate 220.

FIG. 4 illustrates one assembly including additional components of the winch 100. As shown, the gear assembly 400 and related transmission assembly 300 are located proximate to the second side plate 110. Protecting both of these assemblies 400, 500 is the top plate 130 and the bottom plate 220. In addition, the stabilizing bar 125 is located between the first side plate 110 and second side plate 120.

With continued reference to FIG. 4, and as above described, the fairlead 160 helps direct the cable 151 as it retracts and releases from the winch 100. Located behind the fairlead 160 is the rotatable spool 150 that maintains, winds, unwinds and houses the cable 151. To the right of both the spool 150 and fairlead 160 is the second side wall 120.

With continued reference to FIG. 4, the spool 150 connects to the second side wall 120 through a combination of three structures. First, there is a recessed groove 126 on the exterior of the second side wall 120 of sufficient size and dimension to allow the end of the spool 150 to be drawn through the second side wall 120. Second, there is a spool bearing 127 that fits within the groove and connects directly to the end of the spool 150. An end disk connector 128 also connects at the distal end of the spool 150. The exterior dimension of the end disk connector 128 is sufficient to closely mate with dimension of the recessed grove 126. The spool bearing 127 and end disk connector 128 help direct and assist in rotating the spool 150 as it draws the cable 151 in and out. These various components are protected through a rigid outer casing 173.

The Pull-Starter

With reference again to FIGS. 1 and 4, FIG. 5, a detailed view of the components illustrates the pull-starter 170. As shown, these components include a handle 171, which connects to a starter cord 174. The starter cord 174 feeds into pull starter casing 172, which connects to the starter wheel 175. The starter wheel 175 includes an inner groove 176 that helps house the wound starter string 174.

Located between the starter wheel 175 and the starter casing 172 is a coil spring 177. At the distal end of the coil spring 177 is a bent prong 178. The bent prong 178 attaches to the interior of the starter casing 172. When a user pulls the starter string 174 through a grabbing of the handle 171, the starter wheel 175 turns resulting in an uncoiling of the coil spring 177. Upon releasing the handle 171, the coil spring 177 returns to its normal setting, that causes the starter wheel 175 to likewise rotate back to its usual orientation. Put another way, drawing the handle 171 away from the winch 100 causes the starter wheel 174 to turn and release the wound starter string 174—which also uncoils the coil spring 177.

FIG. 5 illustrates how the starter wheel 175 connects with a secondary coil spring 179. Positioned around the secondary coil spring 179 is a drive connector 181. The drive connector 181 connects the starter wheel 175 via a connecting bolt 183. The drive connector 181 directly connects with the two-stroke gas powered engine 500, described earlier with reference to FIG. 3.

The Spool Power Train

Figure 6:
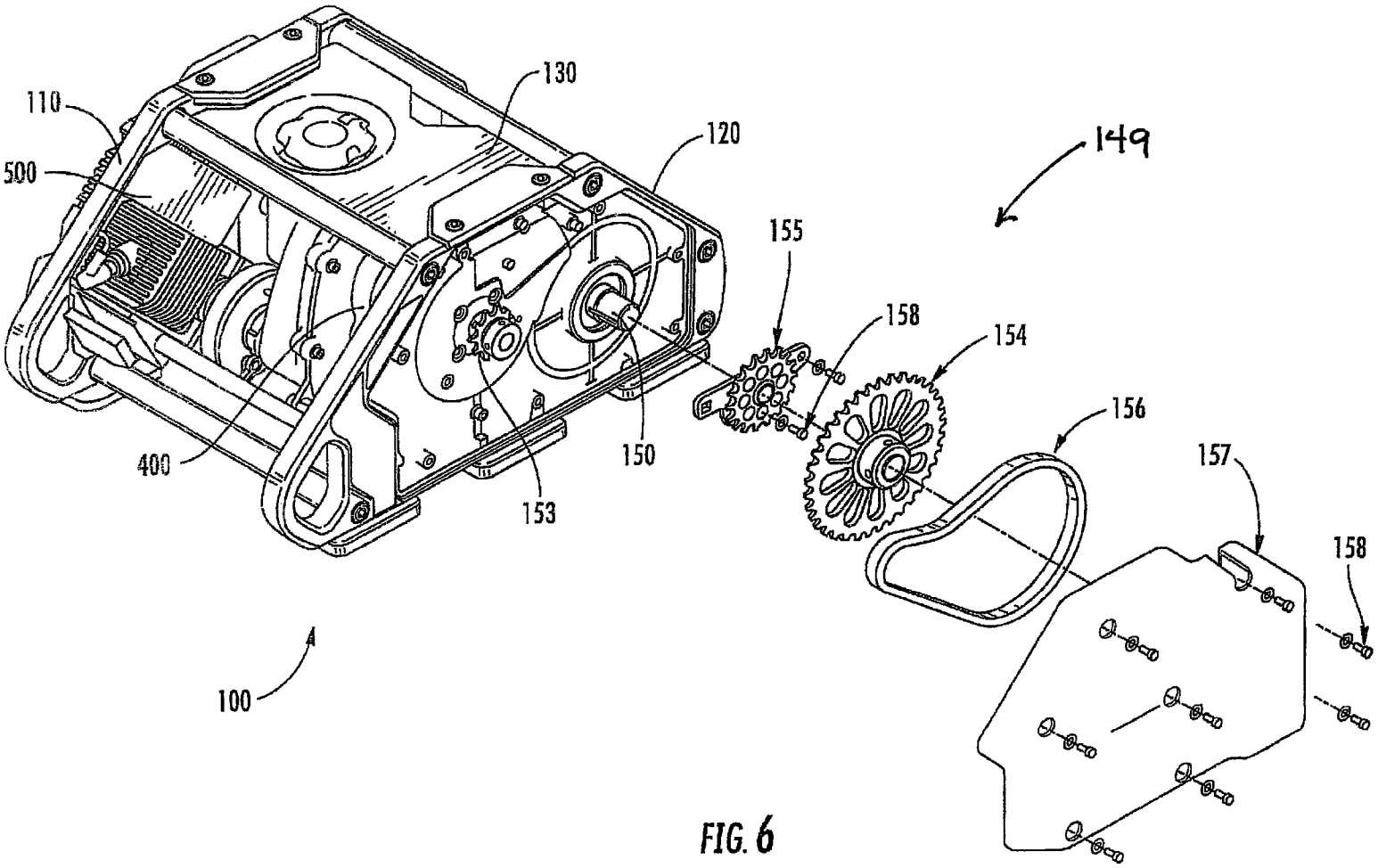
FIG. 6 is an exploded view of the various gears that help drive the spool.

While FIG. 4 illustrated how the spool 150 connects with the first side panel 110, FIG. 6 illustrates how the spool 150 connects with various gears that provide power to drive the spool 150. At a distal end of the gear assembly 400 is a first connecting gear 153. The first connecting gear 153 protrudes from the exterior of the second side panel 120 and connects with an end drive gear 154. A chain tensioner 155 is used to set and maintain tension on a final drive chain 156. The end drive gear 154 has a larger diameter in comparison to both the first connecting gear 153 and the chain tensioner 155 thus adding the final gear reduction of the power train.

FIG. 6 further illustrates how these various gears 153, 154 and 155 are protected from being compromised when the winch 100 is operated. An end gear cover plate 157 is positioned around the gears 153, 154, 155 to help protect the gears from foreign matter, as well as to protect an operator from getting injured by the gears. This end gear cover plate 157 is secured to the second side wall 120 by a plurality of screws 158.

The Transmission Assembly

Figure 7:
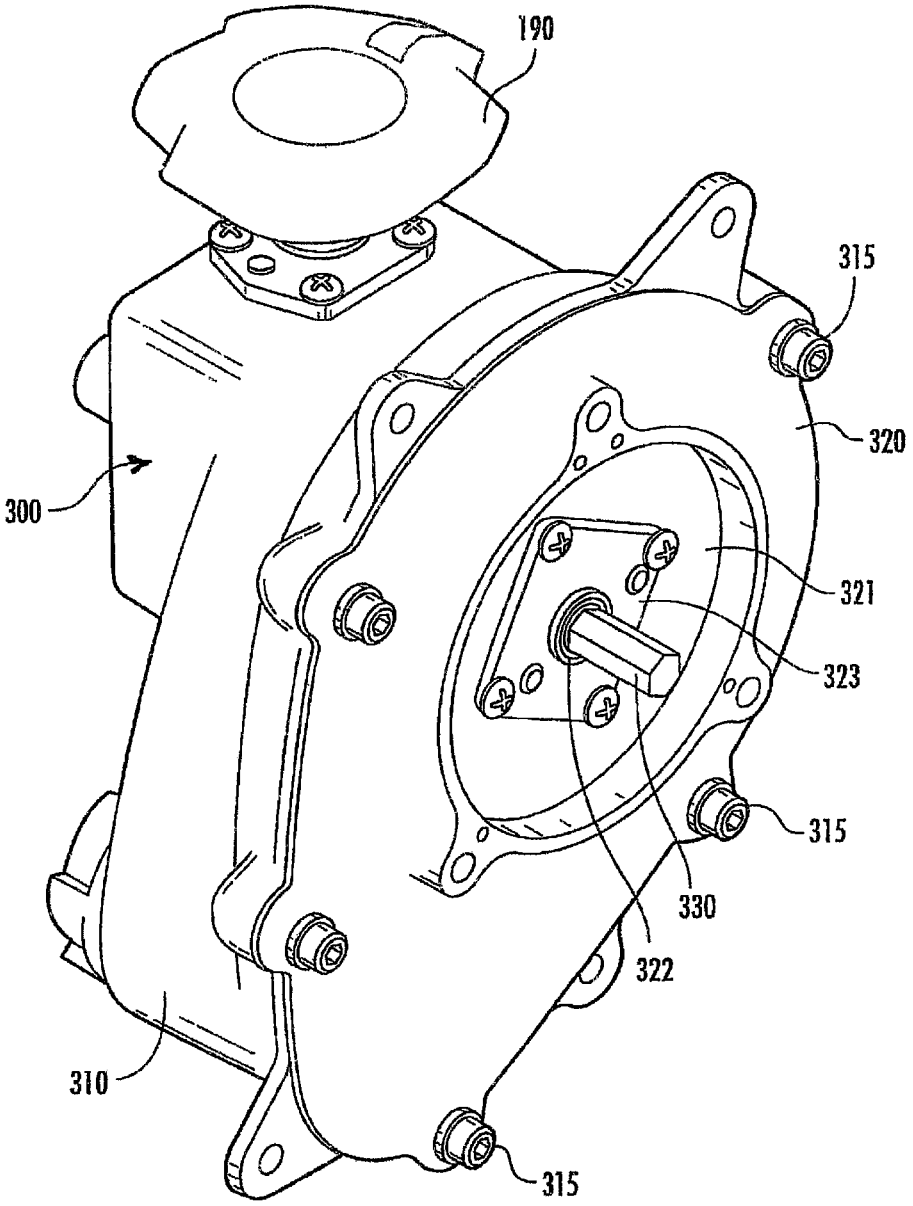
FIG. 7 is a perspective view of the transmission assembly.
Figure 8:
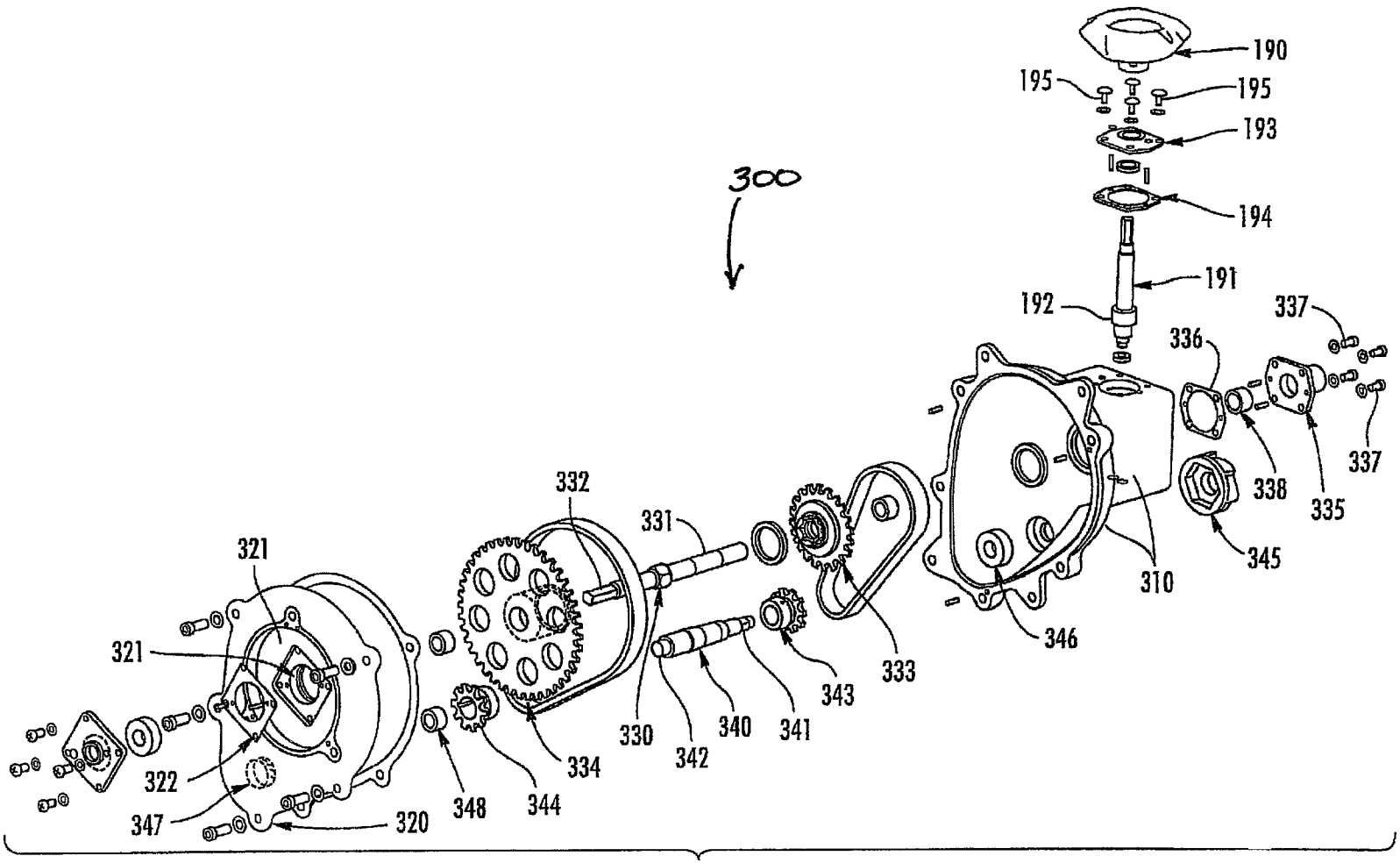
FIG. 8 is an exploded view of the transmission assembly.

FIGS. 7 and 8 illustrate salient components of the transmission assembly 300. One function of the transmission assembly 300 is to regulate an amount of torque when releasing (unwinding) and retrieving (winding) the cable 151 of the winch 100. For example, when lifting and removing heavier loads 250, the transmission knob 190 of the transmission assembly 300 should be set to allow for greater torque that will invariably slow down the rate to retrieve the cable 151.

FIG. 7 illustrates an exterior of the transmission assembly 300 that includes a tear shaped transmission casing 310 enclosed by a separate transmission cover 320. The transmission cover 320 has a particular size and dimension to mirror the shape of the tear shaped transmission casing 310. A series of connector bolts 315 fasten the transmission cover 320 to the transmission casing 310. The transmission plate 320 includes a recess 321. Positioned in the middle of the recess 321 in an opening 322 that allows a transmission drive 330 to exit the transmission assembly 300. A cover plate 323 can be placed over the opening 322. The cover plate 323 has a passage closely sized and dimensioned as the outer diameter of the transmission drive 330.

FIG. 8 provides an exploded view of the transmission assembly 300 illustrating various internal components. By way of example, there are two primary drives including the main transmission drive 330 and a power drive 340. The power drive 340 has a first end 341 and a corresponding second end 342. Positioned near the first end 341 is a first power gear 343, while a second power gear 344 is positioned near the second end 342. The first end 341 of the power drive 340 protrudes outside the transmission casing 310, as described earlier with reference to FIG. 7, and connects directly with the two-stroke gas powered combustion engine 500, illustrated earlier with reference to FIG. 4. A ratcheted end cap 345 having an opening closely sized and dimensioned to fit the outer diameter of the power drive 340 is positioned on the transmission casing 310. Optionally placed between the first power gear 343 and the transmission casing 310 is a first power drive bearing 346. The second end 342 of the power drive 340 rests within a second power drive bearing 348 which is pressed into boss 347 located on the interior side of the flat plate 321.

With continued reference to FIG. 8, one embodiment of the transmission drive 330 includes a first end 331 and a corresponding second end 332. Positioned near the first end 331 is a first transmission gear 333. Similarly, placed near the second end 332 is a second transmission gear 334. The second transmission gear 334 is substantially larger in diameter compared to the first transmission gear 333. The first end 331 of the transmission gear 333 protrudes outside of the transmission casing 310 and is housed by an end cap 335. This end cap 335 is secured to the transmission casing 310 through a gasket 336 secured via a plurality of bolts 337. A bearing 338 can be used to maintain the first end 331 into the end cap 335.

The transmission knob 190 located on top of the transmission casing 310 connects to a rotating shaft 191. At the distal end of the shaft 191 (farthest from the knob 190) is a cantilever member 192. By turning the transmission knob 190, the cantilever member 192 shifts the transmission drive 330 either toward or away from the two-stroke gas combustion engine 500. By twisting the knob 190 at one setting, the cantilever member 192 toggles the transmission drive 330 so that it engages with the first transmission gear 333. Likewise, positioning the knob 191 at a separate setting causes the transmission drive 330 to engage with the second transmission gear 334. A differential torque results based upon the varying diameters of the first transmission gear 333 and the second transmission gear 334.

As further shown in FIG. 8, a cover plate 193 is placed between the transmission knob 190 and the top of the transmission casing 310. A gasket 194 can be placed between the cover plate 193 and the transmission case 310 and secured via multiple bolts 195.

The Gear Assembly

Figure 9:
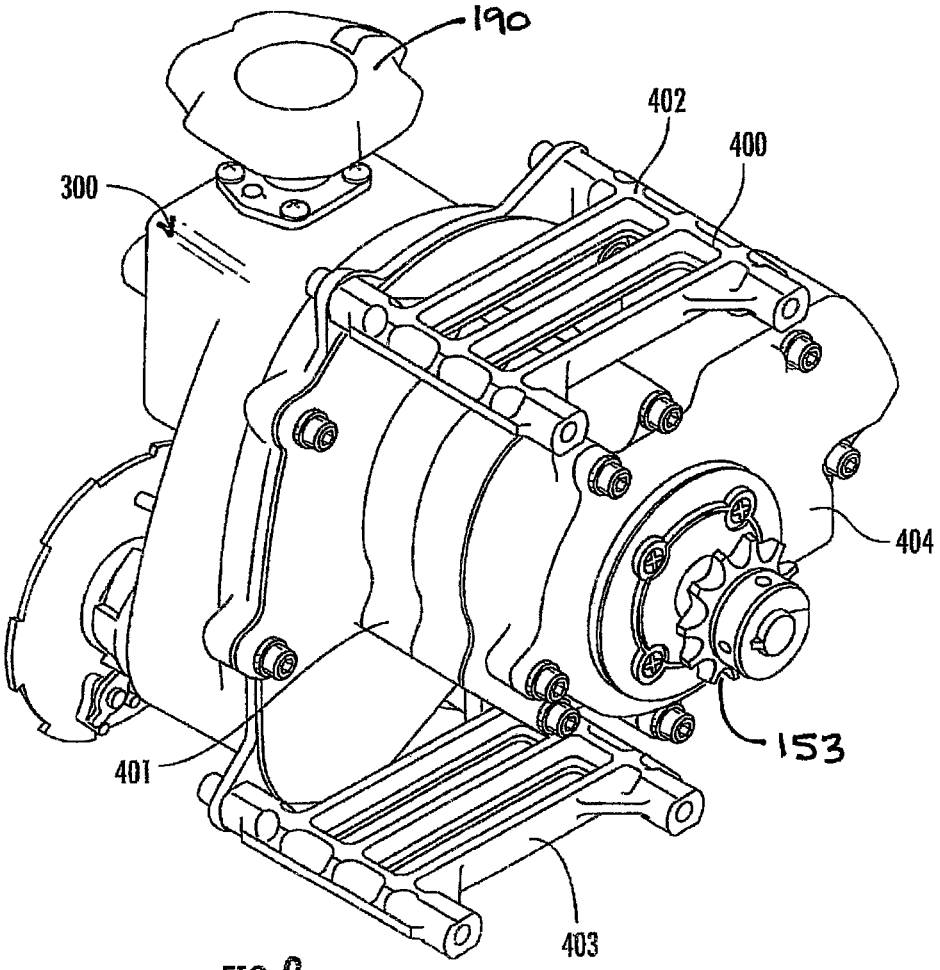
FIG. 9 is a perspective view of the preferred gear assembly.
Figure 10:
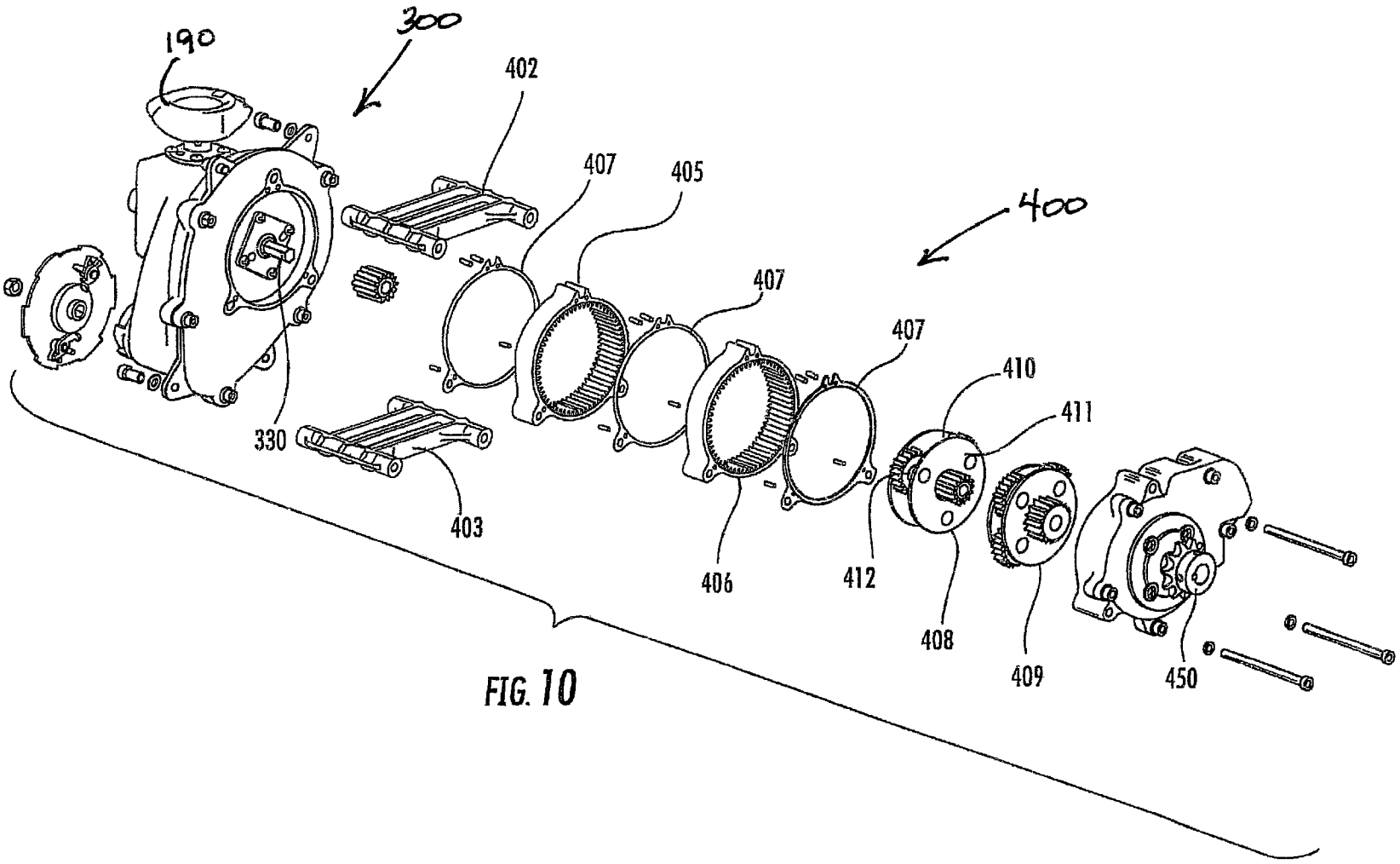
FIG. 10 is an exploded view of the internal components of the preferred gear assembly.
Figure 11:
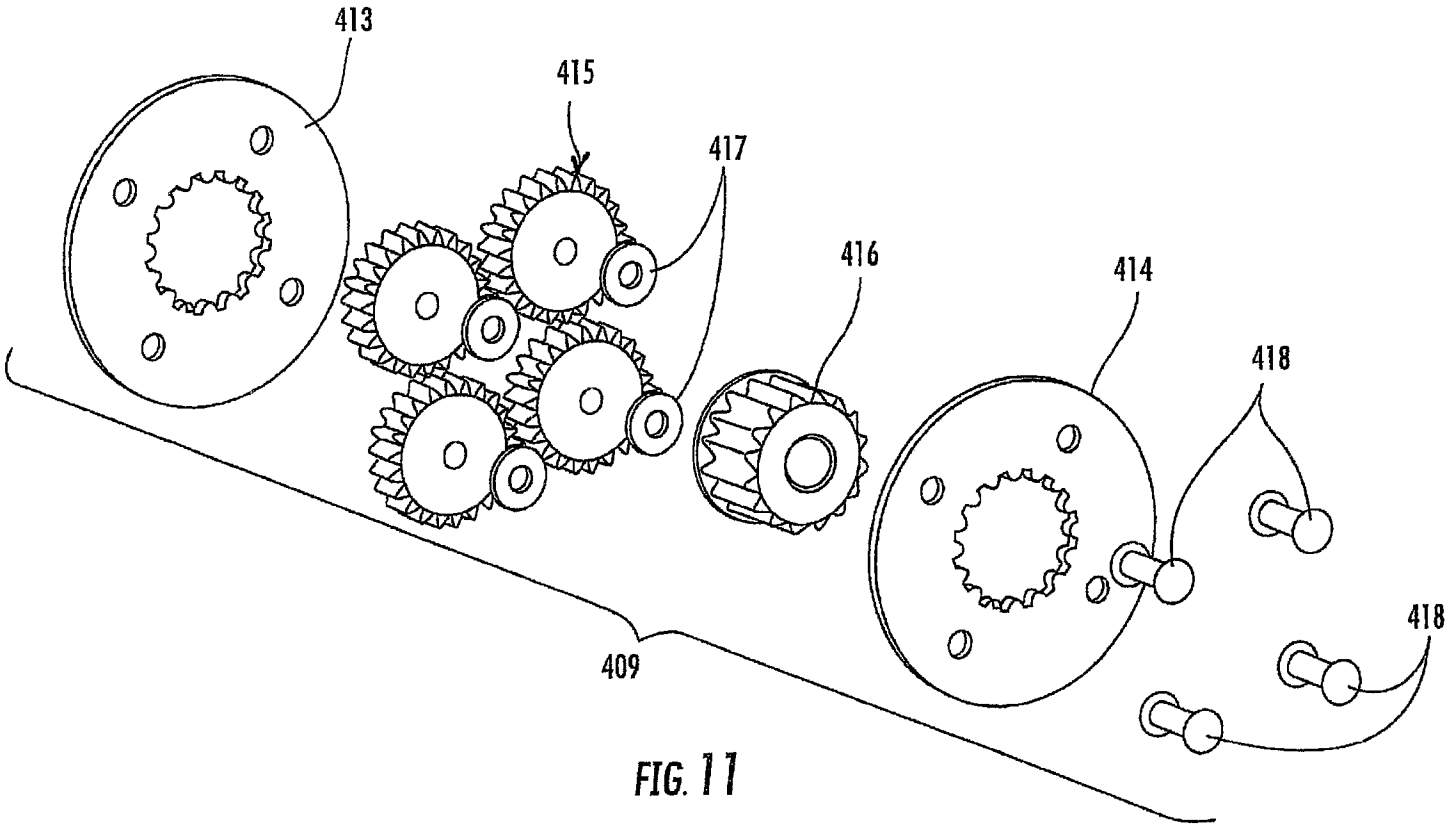
FIG. 11 is an exploded view of the components of the second planetary gear.

FIGS. 9, 10 and 11 illustrate various components of the gear assembly 400. With reference to FIG. 9, the exterior of the gear assembly 400 and the transmission assembly 300 are illustrated with the transmission assembly affixed to the exterior casing 401 of the gear assembly 400. This exterior casing 401 includes a first mounting plate 402, a second mounting plate 403, planetary gear set 408, 409 and a slip clutch assembly 404 (later illustrated and described in greater detail with reference to FIG. 12). In one embodiment, the first mounting plate 402 has the same shape and dimensions as the second mounting plate 403. Exiting the gear assembly 400 is the first connecting gear 153.

While FIG. 9 shows the exterior casing 401 of the gear assembly, FIG. 10 illustrates its various moving components. These components include a first threaded ring 405 and a corresponding second threaded ring 406. Positioned on both sides of these threaded rings 405, 406 are multiple gaskets 407. These gaskets 407 not only help seal the threaded rings 405, 406 to each other but also to the transmission cover 320 and the outer casing 601.

In addition, FIG. 10 illustrates both a first planetary gear 408 and a corresponding second planetary gear 409. Both planetary gears 408, 409 have essentially the same outer diameter and are capable of fitting into the threaded rings 405, 406. The first planetary gear 408 includes a circular first planet carrier 410 and a corresponding circular second planet carrier 411 in parallel relation to one another. Fitted between both the planetary carriers 410, 411 are a plurality of planet gears 412. The gear teeth of these various planet gears 412 are capable of engaging the gear teeth of the first ring 405. Each of the various planet gears 412 within the first planetary gear 408 have essentially the same size, width, dimension and number of threads.

FIG. 11 illustrates the various components that comprise the second planetary gear 409. As shown, the second planetary gear 409 includes a first planet carrier 413 and a corresponding second planet carrier 414 in parallel relation to one another. The first planet carrier 413 has the same size and outer dimensions as the second planet carrier 414. Positioned between the parallel carriers 413, 414 are four planet gears 415. Each planet gear 415 has essentially the same size, width, dimension and number of teeth. A sun gear 416 protrudes through the second planet carrier 414, and in turn connects with the clutch assembly 404 (shown in FIGS. 12 and 13). A combination of multiple washers 417 and rivets 418 help connect the planet carriers 413, 414 to the rotatable planet gears 415.

Both planetary gears 408 and 409 illustrated in FIGS. 10 and 11 provide multiple functions for the gear assembly 400 including a function of increasing the torque and decreasing a speed directed to the spool 150, described above with reference to FIG. 1.

The Clutch/Brake Assembly

Figure 12:
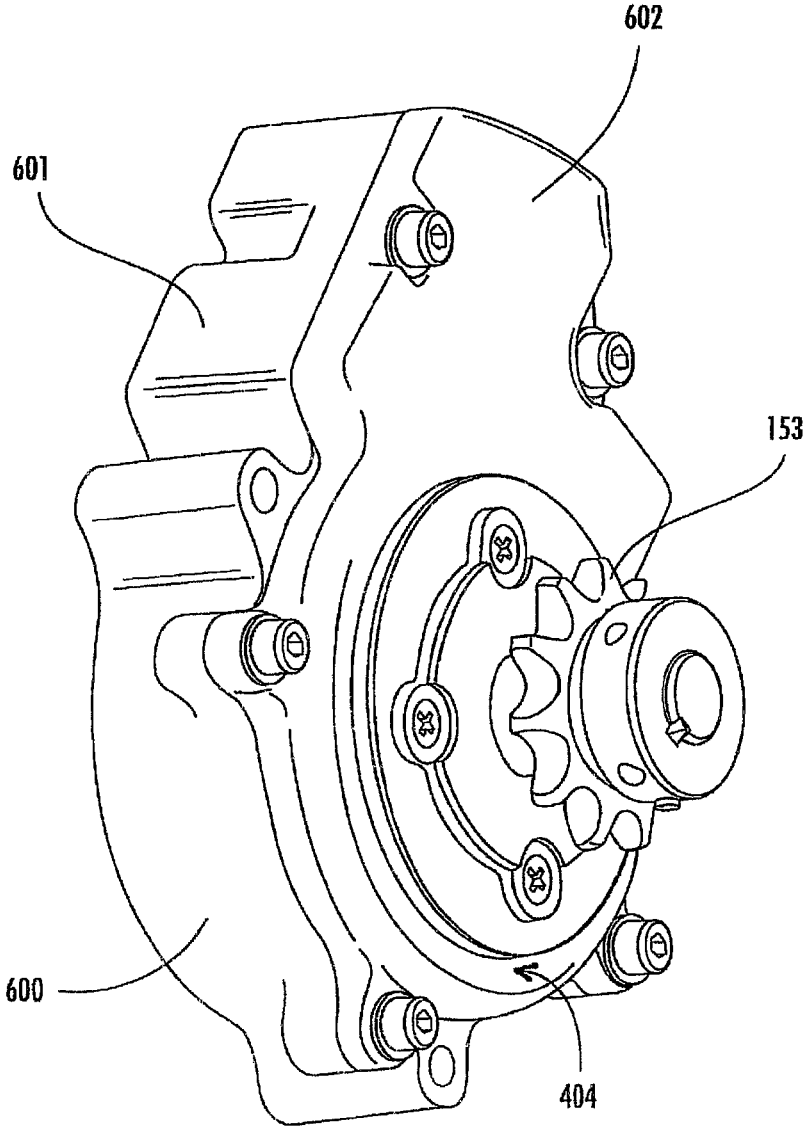
FIG. 12 is a perspective view of the exterior of the clutch assembly.
Figure 13:
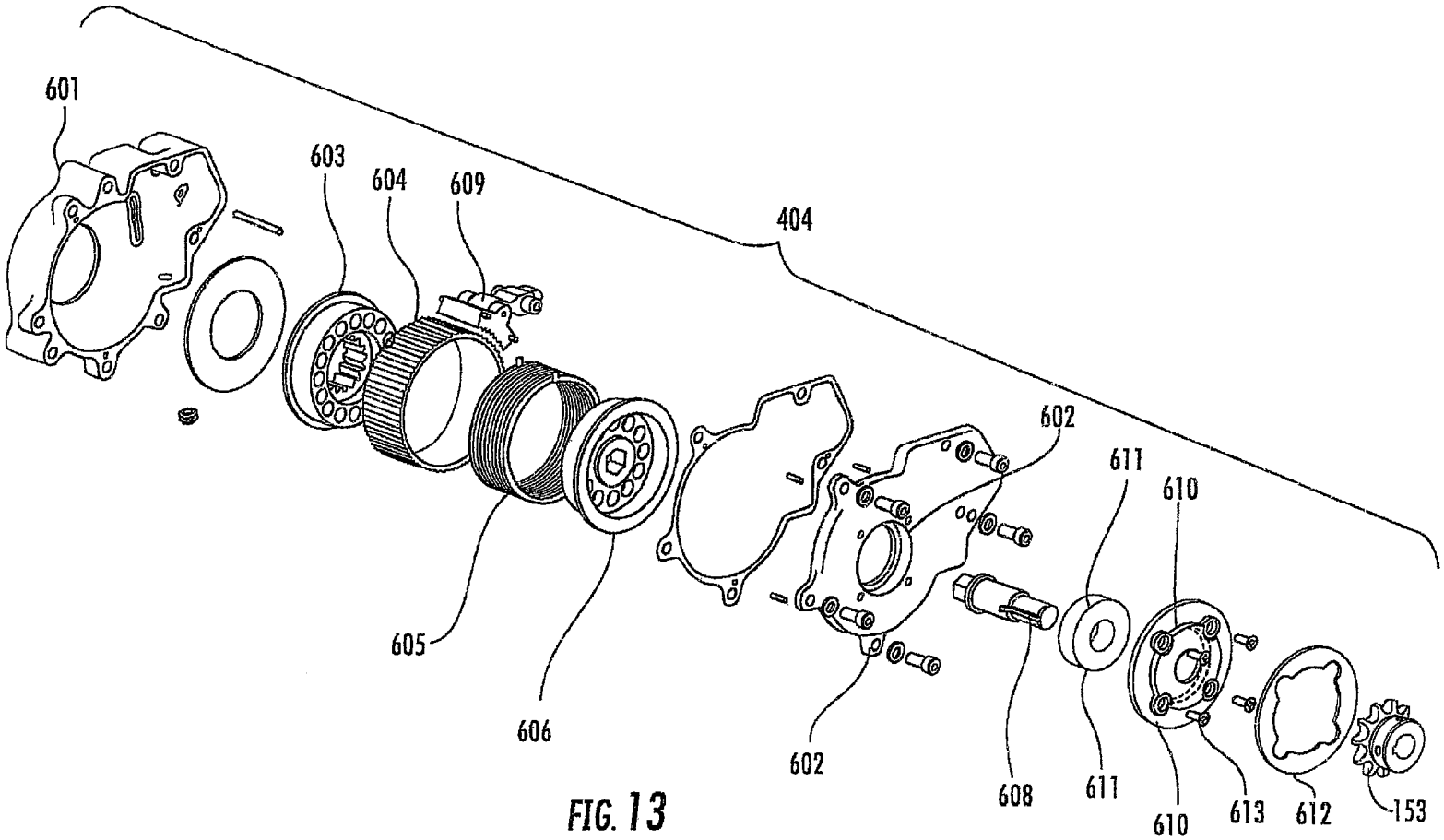
FIG. 13 is an exploded view of the clutch assembly.

The clutch/brake assembly 404 illustrated in FIG. 12 and FIG. 13, while part of the general gear assembly 400 (shown in FIG. 3), and is also separate and distinct assembly with multiple parts. Moreover, the assembly 404 connects with the control cable 214 (shown in FIG. 2B), which in turn connects to the hand controller 210 (also shown in FIG. 2B and discussed above). Accordingly, the clutch/brake assembly 404 shown in FIG. 12 helps control the rate of release of the cable 151 through operation of the hand controller 210.

FIG. 12 offers one preferred embodiment of the clutch enclosure 600 of the clutch/brake assembly 404. This includes a rigid outer casing 601 and a corresponding flat plate 602. Exiting the clutch enclosure 600 is the first connecting gear 153 (illustrated in FIG. 6) that powers the spool 150 (illustrated earlier with reference to FIG. 1).

FIG. 13 illustrates various internal components of the clutch/break assembly 404. There are six main components of the clutch assembly 404 including a first connecting hub 603, a faceted clutch ring 604, a coil spring 605, a second connecting hub 606, a clutch drive 608 and a threaded arm member 609. The first connecting hub 603 connects with the second carrier/gear plate 414 found on the second planetary gear 409 (shown in FIGS. 10 and 11). Next, the first connecting hub 603 feeds into the threaded clutch ring 605. The threaded clutch ring 605 has an inner diameter that is greater than the outer diameter of the first connecting hub 603. Moreover, this faceted clutch ring 604 has a smooth inner surface and a treaded outer surface capable of making contact with corresponding threads on a pivoting threaded arm member 609.

FIG. 13 further illustrates how a coil spring 605 is positioned within the smooth inner surface of the faceted clutch ring 604. More specifically, the coil spring 605 fits over the first connecting hub 603 and inside of the faceted clutch ring 604. Likewise, the second connecting hub 606 is positioned within the coil spring 605. The second connecting hub 606 attaches directly to the clutch drive 608 which in turn leads to the connecting gear 153 that powers the spool 150 (shown in FIG. 1). The clutch drive 608 is seated in bearing 611 and is held in place with bearing plate 610 and gasket 612 and is secured to the flat plate 602 by a series of bolts 613.

Further illustrated in FIG. 13 is the pivot faceted arm member 609. Through engaging the hand controller 210 (shown in FIG. 2B), the control cable 213 pivots the faceted arm member 609 onto the faceted clutch ring 604, which in turn engages the coil spring 605. This helps control and slow release of the cable 151.

There are additional benefits of this release mechanism allowed by the clutch/brake assembly 404. First, if there is any change in tension on the cable 151 (not shown) during operation of the winch 100, there is no stripping of the various gears within the transmission assembly 400. In addition, the combination of the coil spring 605 and connecting gears 603, 606 ensure that if there is a change in direction of the cable 151 this does not compromise the two-stroke engine 500.

Optionally, the clutch/brake assembly 404 can include a group of spring loaded clutch shoes housed within a drum. This operates akin to the brake shoes on a car. In one embodiment, these spring-loaded brake shoes travel with the output of the two-stroke engine 500 and the drum is connected to the input shaft of the transmission assembly 300. At idle speeds, the springs hold the shoes so that they do not come into contact with the drum. As the engine speed is increased the centrifugal force on the shoes increases to a point that they overcome the springs and move outwardly enough to press against the drum, which in turn begins turning the transmission assembly input shaft.

Figure 14:
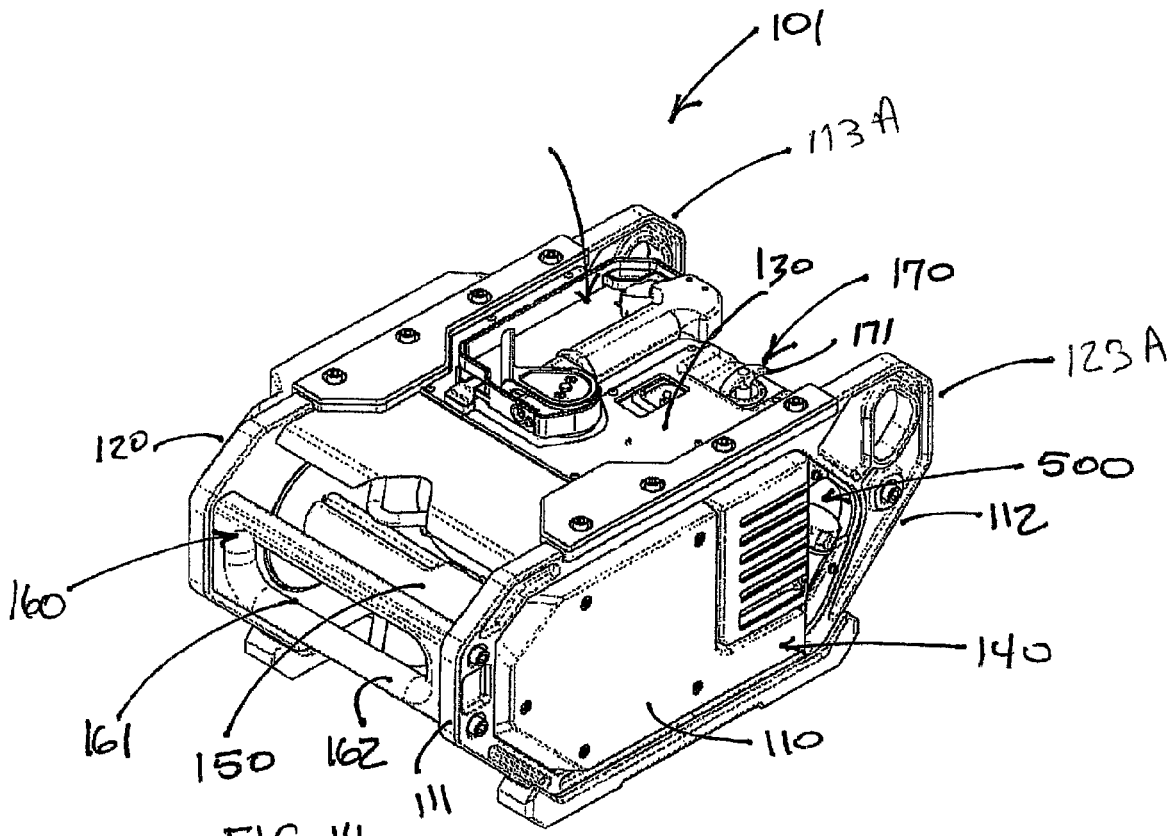
FIGS. 14, 15 and 16 are right front, right rear, and left front perspective views, respectively, of a winch in keeping with teachings of improvements of the invention herein described.
Figure 15:
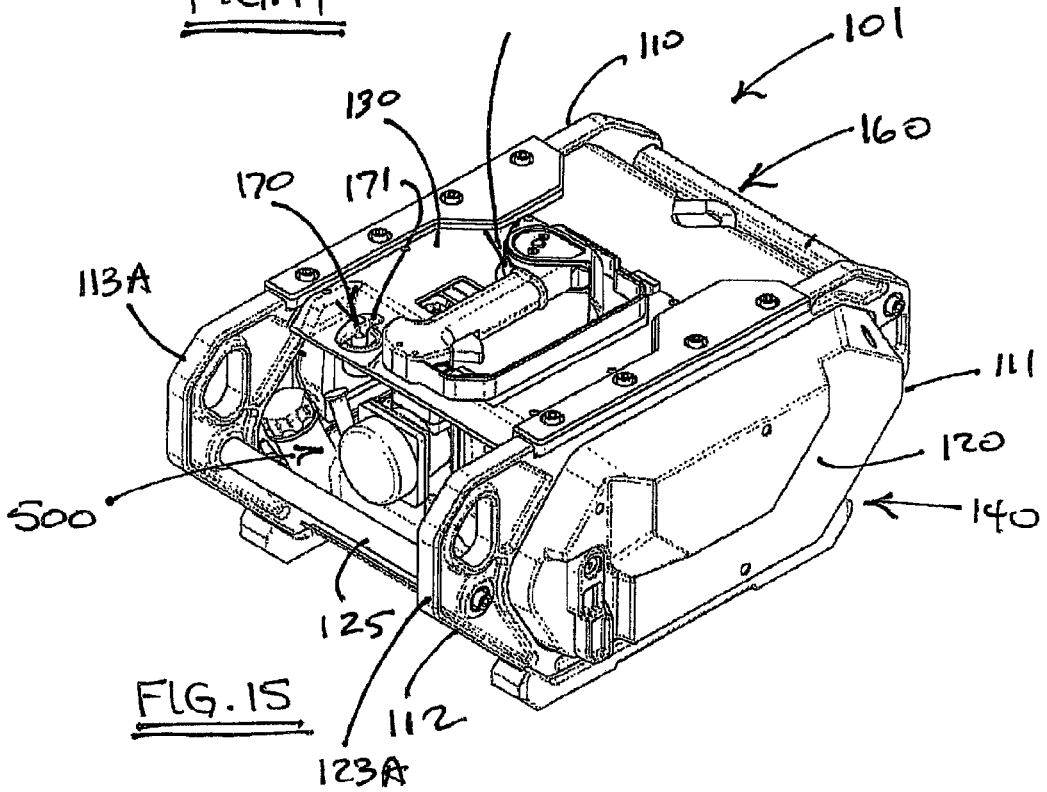
Figure 16:
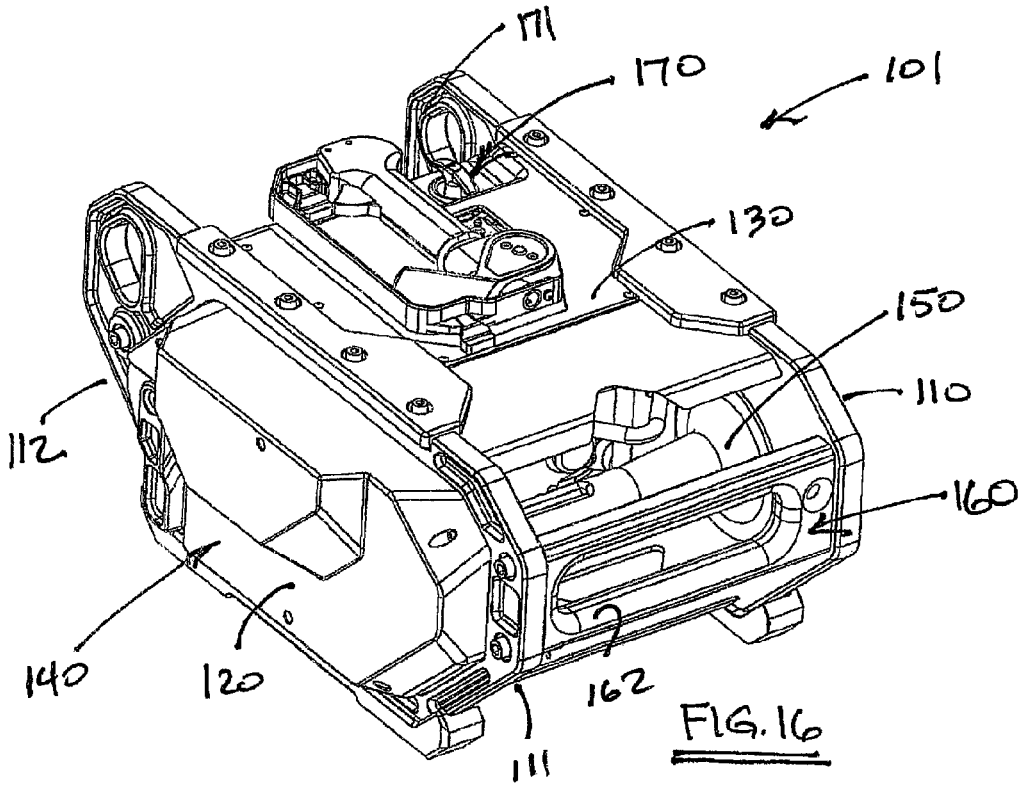

With reference now to FIGS. 14, 15 and 16, a winch 101, an improved embodiment of the winch 100 above described, is herein illustrated and described by way of example. As described above for the winch 100, the winch 101 may be described as including a first side wall no and a corresponding second side wall 120, generally parallel to the first side wall 110. The first side wall 110 is essentially flat and includes a front side 111 and a corresponding back side 112. Likewise, the second side wall 120 is essentially flat and includes a front side 121 and a corresponding back side 122. Located between the side walls 110, 120 is a top wall 130. The walls 110, 120, 130 form the rigid and durable exterior casing 140. The first side wall 110 and the second side wall 120 maintain the spool 150 which houses, winds, unwinds, releases and retracts the cable 151, illustrated with reference again to FIG. 1.

Figure 17:
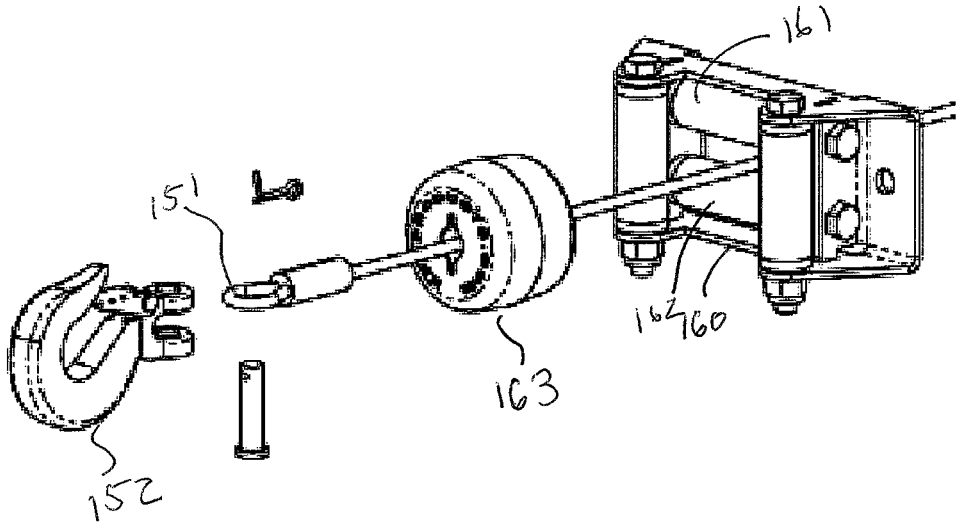
FIG. 17 is a front perspective view of one embodiment of a connector and cable extending from a fairlead of the winch, wherein a float attached proximate the connector allows the connector to be buoyed and float in water.

The cable 151 is connected to the connector 152, herein illustrated by way of example as a hook. As earlier described, the fairlead 160 includes a passage 161 and resting surface 162. The fairlead 160 creates an opening to allow the cable 151 to release and retract from the winch 100, and the resting surface 162 provides a strong structure where the cable 151 rests while it pulls, dislodges and moves various loads 250 during use. As illustrated with reference to FIG. 17, a float 163 or any material that has sufficient buoyancy to keep the connector 152 from sinking in water is carried by the cable 151 proximate the connector 152. With a rope that floats used for the cable 151, the addition of a floating hook is desirable for water rescues.

With continued reference to FIGS. 14, 15 and 16, and as above described with reference to FIG. 1, the pull-starter 170 includes a handle 171 that the user pulls to start the engine 500.

For the improved embodiment of the winch 101, the two rigid attaching members 113, 123, earlier described with reference to FIG. 2A are relocated and herein referenced as attaching members 113A, 123A, as illustrated with reference to FIGS. 14 and 15, by way of example. The attaching members 113A, 123A are in a parallel relationship to one another and include the openings 114, 124 of sufficient size and dimension to allow a hook or other strong gripping device to cling to the winch 101. The stabilizing bar 125 is positioned between the attaching members 113A, 123A. In addition, an attachment ring 115 is carried by the winch 101 and is elevated generally above the bar 125. With such a structure as herein now described, and as illustrated with reference to FIG. 18, a enter of gravity 129 of the winch 101 is below a force line 131 created between the cable 151 pulling on the spool 150 and the attaching members 113A, 123A attached to a supporting structure, such as a tree, piling, and the like.

Figure 18:
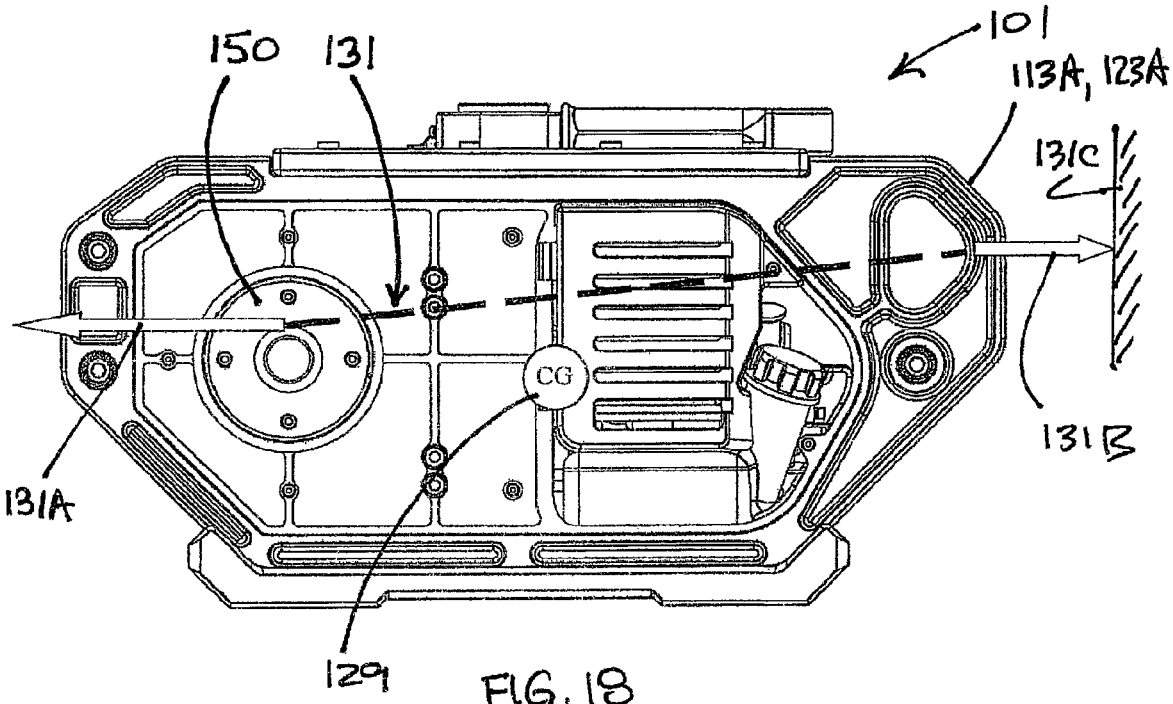
FIG. 18 is a right side view of the embodiment of FIG. 14 illustrating a pulling force line therethrough passing above a center of gravity thereof.

With continued reference to FIG. 18, arrows 131A, 131B diagrammatically illustrate forces on the winch 101, wherein the left arrow 131A represents the force from the load 250 on the cable 151 and the arrow 131B on the right shows a balancing force from an anchor 131C, such as the tree, piling, and the like above described. With the center of gravity 129 below the force line 131, if the winch 101 comes up off the ground upon which it was positioned during operation, it will not flip over but will "hang" from the cable and any anchor lines used to connect the attaching members 113A, 123A to the anchor 131C.

Figure 19:
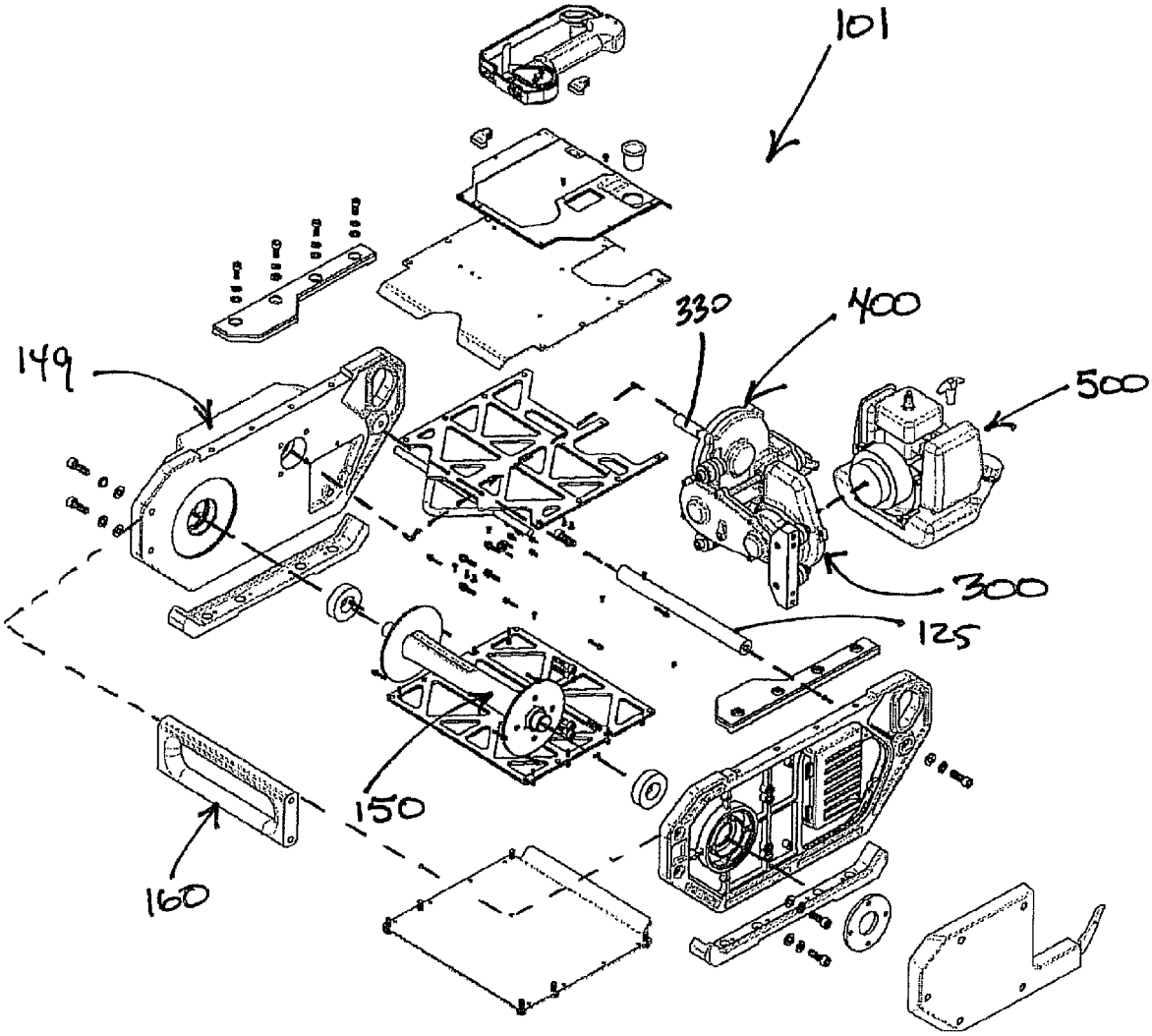
FIG. 19 is a partial front perspective exploded view of the embodiment of FIG. 1.
Figure 20:
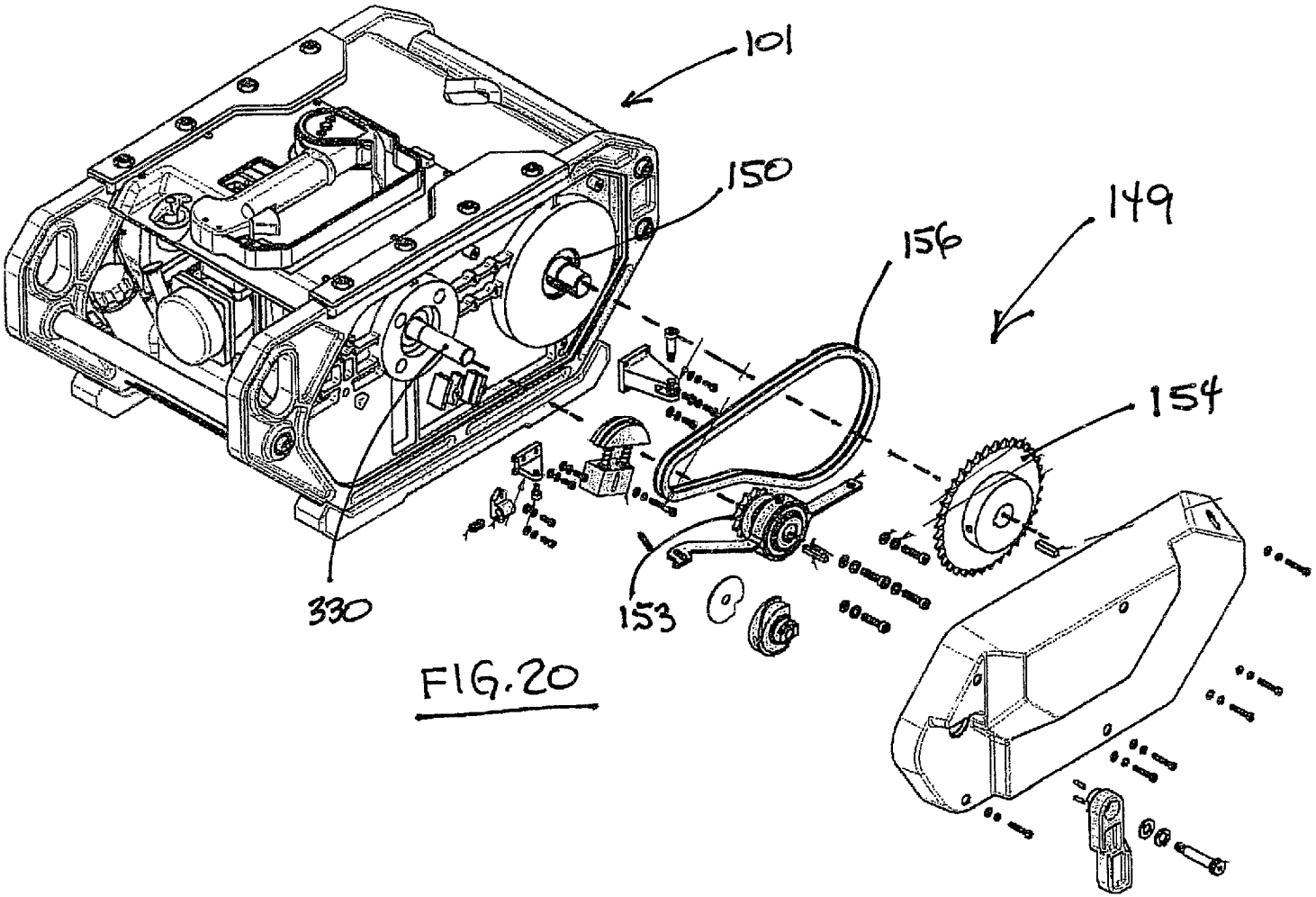
FIG. 20 is an exploded view illustrating an improved spool power train operable with the winch of FIG. 1.
Figure 21:
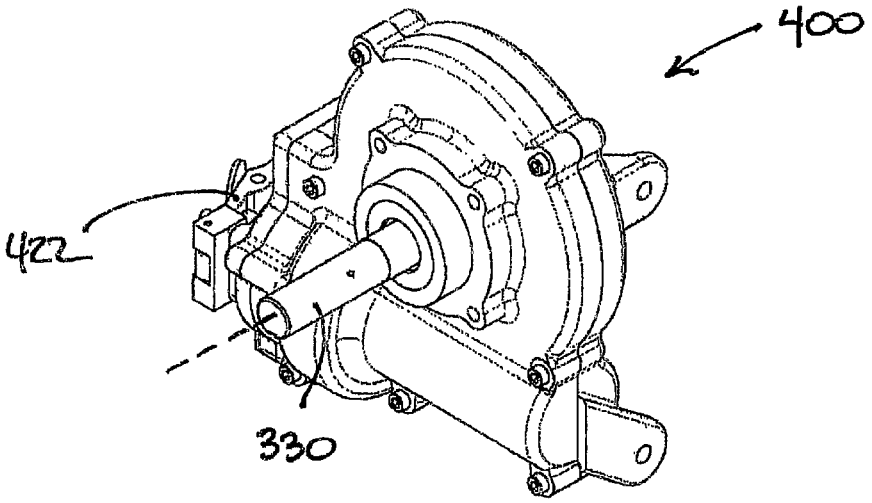
FIGS. 21 and 22 are left and right side perspective views, respectively, of a gearbox assembly employed in the winch of FIG. 1.
Figure 22:
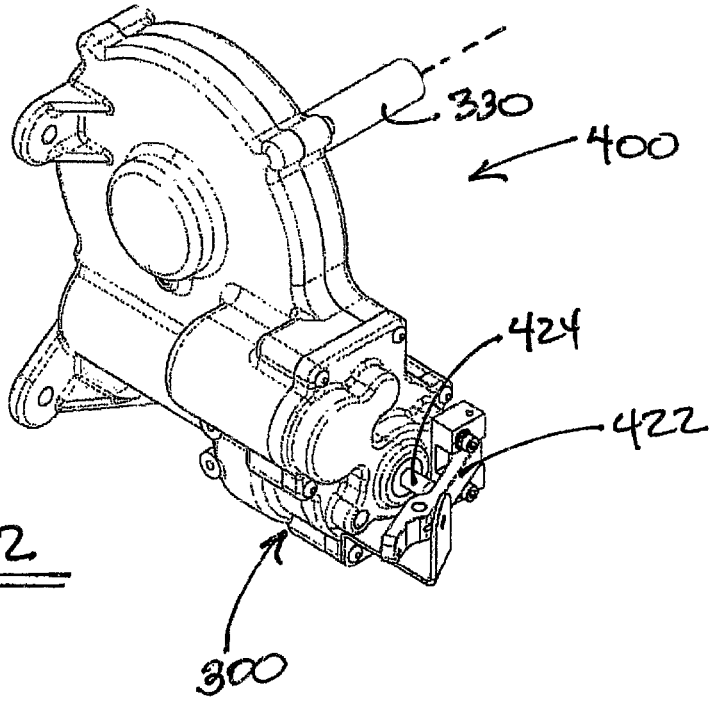
Figure 23:
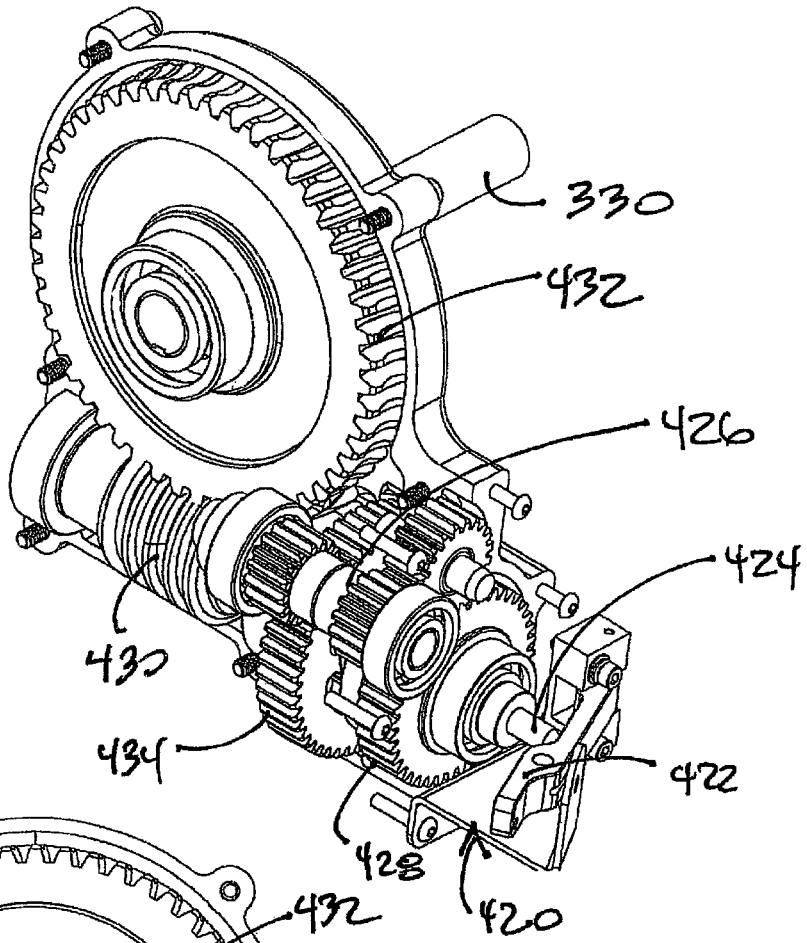
FIGS. 23 and 24 are perspective and side views, respectively, of on opened gearbox assembly of FIG. 22, illustrating internal elements.
Figure 24:
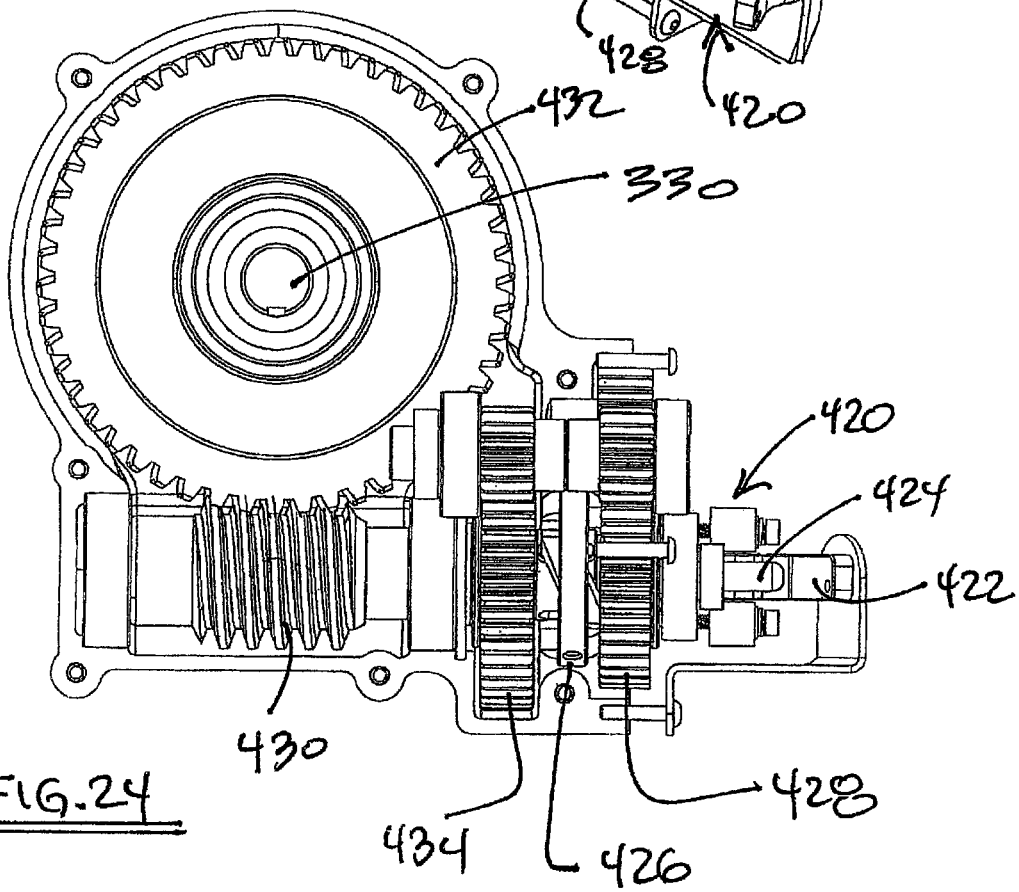
Figure 25:
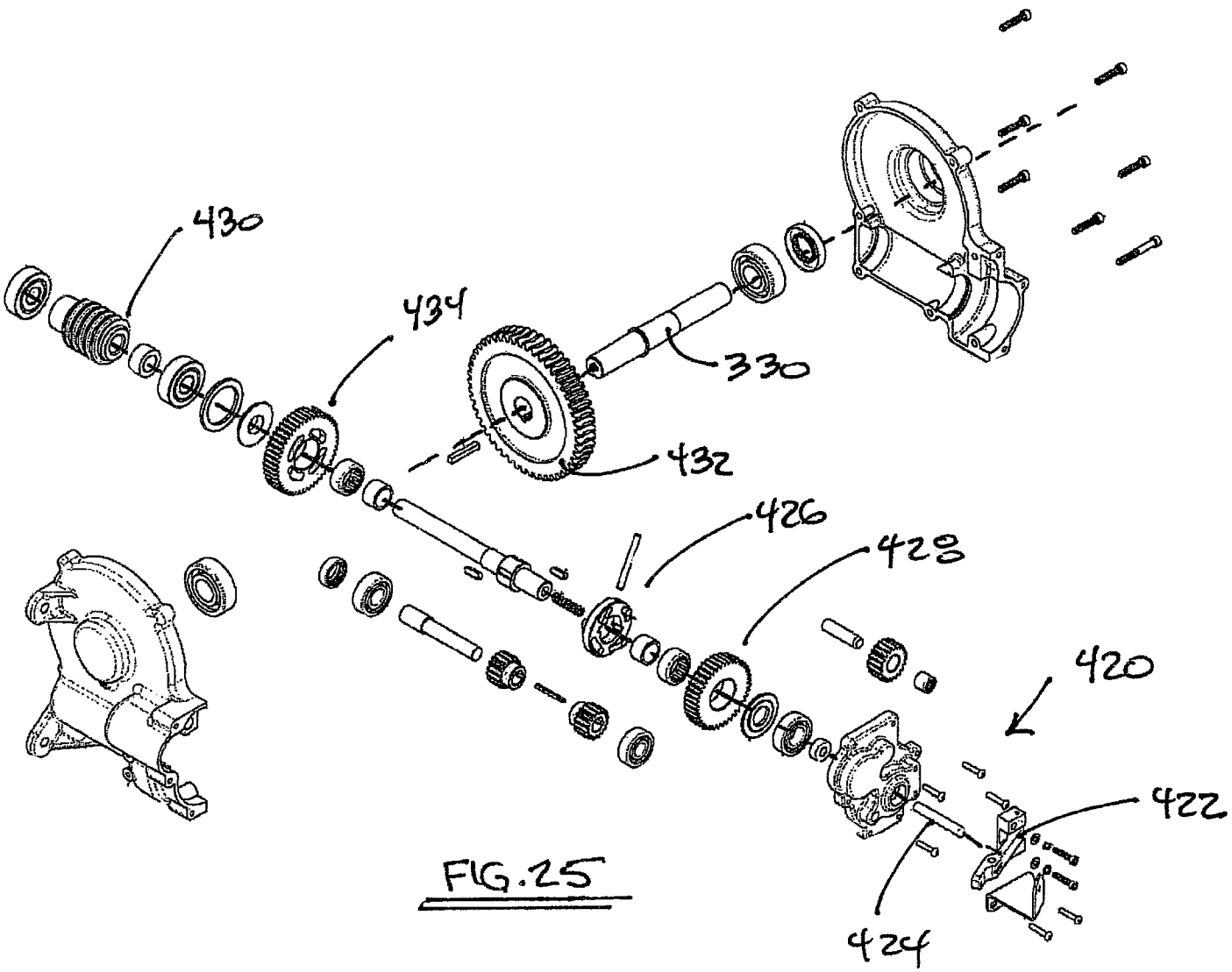
FIG. 25 is an exploded view illustrating elements of the gearbox assembly of FIG. 22.

With reference now to FIGS. 19 and 20, as earlier described for the winch 100, the winch 101 may be described as having the engine 500 operable with a transmission assembly 300, which itself is operable with the gear assembly 400. The gear assembly 400 is operable with a spool power train 149 to drive the spool 150 using the drive 330.

With reference now to FIGS. 21-25, improvements to the transmission and gear assemblies 300, 400 are now described. As illustrated with reference to FIGS. 21 and 22, the transmission drive 330 remains operable with the spool power train. However, as illustrated with reference to FIGS. 23 and 24, a forward and reverse capability is made available using a shift mechanism assembly 420 having a shift handle 422 operable with a shift rod 424 for driving a dog clutch 426 to offset positions. A first off set position results in a forward gear 428 being engaged to drive a worm gear 430 in a first direction, which worm gear is engaging a gear wheel 432 driving the transmission drive 330 for reeling in the cable. Alternatively, operating the shift handle 422 to move the dog clutch 426 to an opposing offset position results in a reverse gear 434 driving the worm gear 430 is a counter direction which results in the gear wheel 432 rotating the transmission drive 330 for reversing rotation of the spool 150 and unwinding the cable. While elements of the transmission and gear assemblies are herein presented as illustrated with reference to the exploded view of FIG. 25, by way of example, those of skill in the art will recognize that alternate embodiment are possible while keeping within the teachings of the present invention.

As an aside, and as is well known in the art, a dog clutch is a type of clutch that couples two rotating shafts or other rotating components not by friction, but by interference. The clutch is designed such that one portion will push the other, causing both to rotate at the same speed and will not slip. While found to be desirable for the embodiment herein described, alternate clutch assemblies will come to the mind of those skilled in the art now having the benefit of the teachings of the present invention.

As above described with reference to FIG. 2B, the hand controller 210 for the winch 100 control cables 213, 214 are encased in a controller tubing 215. The first control cable 213 is connected to the pivoting trigger member 211 for controlling the rate of acceleration of the cable 151 when moving the loads 250. The second control cable 214 is connected to the rotatable rate instrument 212 for regulating the rate of release of the cable 151. The control cables are connected to the two-stroke gas powered engine 500 and clutch assembly 404, illustrated with reference to FIGS. 3, 4, 12 and 13 and discussed in greater detail below.

Figure 26:
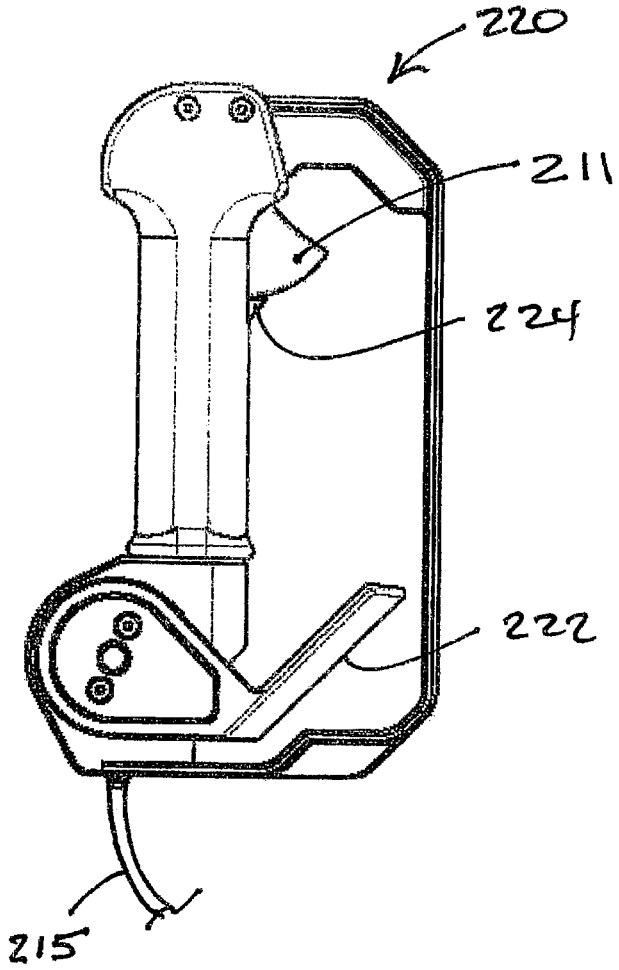
FIG. 26 is a side view of a hand held remote control operable with the winch of FIG. 14.

With reference again to FIGS. 14, 15, 19 and 20, and now to FIG. 26, a remote control handle 220 now has the throttle 211, a reverse power out lever 222, and kill switch 224 built in so that the user can completely control pulling in under load, power out under load, and stopping the engine all from the remote. Pulling the reverse lever 222 up moves the dog clutch 426 to the left and engages the reverse gear 434. Releasing the lever 222 allows the dog clutch 426 to move back to the right which engages the forward gear 428. The winch 101 is preferably in forward mode by default.

As will be appreciated by those skilled in the art, the winch 101 has the ability to remove and respool the cable via the drum groove. A user can remove the entire cable, insert a rope through the hole in the fairlead, wrap it around the drum from outside into the middle, pull it up though the hook attachment loop, and use the winch drum as a capstan. This allows the winch to operate at its maximum pulling power through the entire length of the rope.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of claims supported by this disclosure.

Having thus described my invention, I claim:

1. A self-contained gas powered winch, comprising:

a combustion engine;

a transmission assembly connected to the combustion engine;

a gear assembly connected to transmission drive;

a clutch assembly connected to the transmission drive though the gear assembly, the clutch assembly having a first connecting gear which fits within a threaded clutch ring which in turn is contacted by a pivoting threaded arm member;

a spool positioned between a first side wall and second side wall that is connected to the clutch assembly, the spool capable of winding and unwinding a cable;

a hand controller connects to the clutch assembly, the hand controller having at least one clutch cable in communication with the pivoting threaded arm member capable of applying pressure to the threaded clutch ring to regulate the rate of release of the cable;

attaching members located on the self-contained gas powered winch superior to a center of gravity of the self-contained gas powered winch;

said attaching members being in a parallel relationship to one another and including the openings of sufficient size and dimension to allow a gripping device to cling to the self-contained gas powered winch, thereby providing the self-contained gas powered winch with a center of gravity below a force line.

2. The winch of claim 1, further comprising:

an external casing having a first side wall, a corresponding second side wall, and a top wall, the external casing capable of housing and maintaining the combustion engine, transmission assembly, gear assembly and spool.

3. The winch of claim 1, wherein:

the clutch assembly includes a clutch enclosure capable of protecting components of the clutch assembly.

4. The winch of claim 2, wherein:

the external casing further includes a fairlead which helps support the cable when released and retrieved from the spool.

5. The winch of claim 2, wherein:

the external casing including a stabilizing bar placed between ends of the first side wall and second side wall.

6. The winch of claim 1, further comprising:

a pull-start having a handle attached to a starter string, the starter string being fed into a starter casing and connected to a rotatable starter wheel.

7. The winch of claim 1, wherein:

the spool connects with the gear assembly through the first connecting gear communicating with a middle connecting gear which in turn connects to an end drive gear which is attached to the spool; and the end drive gear having a diameter larger than the first connecting gear and middle connecting gear.

8. The winch of claim 1, wherein:

the first connecting gear, middle connecting gear and end drive gear are protected through use of a rigid casing.

9. The winch of claim 1, wherein:

the gear assembly includes at least one planetary gear and at least one threaded ring.

10. The winch of claim 9, wherein:

each of said at least one planetary gear has a plurality of planet gears able to fit into a recess within each respective of said at least one threaded ring and receiving an end of the transmission drive.

11. The winch of claim 10, wherein:

the gear assembly also includes a first mounting plate and a second mounting plate to help maintain the planetary gear and threaded ring.

12. A self-contained gas powered winch, comprising:

a combustion engine;

a transmission assembly connected to the combustion engine;

a gear assembly connected to transmission drive;

a clutch assembly connected to the transmission drive though the gear assembly, the clutch assembly having a first connecting gear which fits within a threaded clutch ring which in turn is contacted by a pivoting threaded arm member;

a spool positioned between a first side wall and second side wall that is connected to the clutch assembly, the spool capable of winding and unwinding a cable;

a hand controller connects to the clutch assembly, the hand controller having at least one clutch cable in communication with the pivoting threaded arm member capable of applying pressure to the threaded clutch ring to regulate the rate of release of the cable;

an external casing having a first side wall, a corresponding second side wall, and a top wall, the external casing capable of housing and maintaining the combustion engine, transmission assembly, gear assembly and spool;

the external casing further includes a fairlead which helps support the cable when released and retrieved from the spool; and a drum having a drum groove located thereon that allows a user to use the winch as a capstan.

13. The winch of claim 12, wherein:

the clutch assembly includes a clutch enclosure capable of protecting components of the clutch assembly.

14. The winch of claim 12, wherein:

the external casing including a stabilizing bar placed between ends of the first side wall and second side wall.

15. The winch of claim 12, further comprising:

a pull-start having a handle attached to a starter string, the starter string being fed into a starter casing and connected to a rotatable starter wheel.

16. The winch of claim 12, wherein:

the spool connects with the gear assembly through the first connecting gear communicating with a middle connecting gear which in turn connects to an end drive gear which is attached to the spool; and the end drive gear having a diameter larger than the first connecting gear and middle connecting gear.

17. The winch of claim 12, wherein:

the first connecting gear, middle connecting gear and end drive gear are protected through use of a rigid casing.

18. The winch of claim 12, wherein:

the gear assembly includes at least one planetary gear and at least one threaded ring.

19. The winch of claim 18, wherein:

each of said at least one planetary gear has a plurality of planet gears able to fit into a recess within each respective of said at least one threaded ring and receiving an end of the transmission drive.

20. The winch of claim 19, wherein:

the gear assembly also includes a first mounting plate and a second mounting plate to help maintain the planetary gear and threaded ring.

21. A self-contained gas powered winch, comprising:

a combustion engine;

a transmission assembly connected to the combustion engine;

a gear assembly connected to transmission drive;

a clutch assembly connected to the transmission drive though the gear assembly, the clutch assembly having a first connecting gear which fits within a threaded clutch ring which in turn is contacted by a pivoting threaded arm member;

a spool positioned between a first side wall and second side wall that is connected to the clutch assembly, the spool capable of winding and unwinding a cable;

a hand controller connects to the clutch assembly, the hand controller having at least one clutch cable in communication with the pivoting threaded arm member capable of applying pressure to the threaded clutch ring to regulate the rate of release of the cable; and a forward and reverse capability is made available using a shift mechanism assembly having a shift handle operable with a shift rod for driving a dog clutch to offset positions.

22. The winch of claim 21, further comprising:

an external casing having a first side wall, a corresponding second side wall, and a top wall, the external casing capable of housing and maintaining the combustion engine, transmission assembly, gear assembly and spool.

23. The winch of claim 21, wherein:

the clutch assembly includes a clutch enclosure capable of protecting components of the clutch assembly.

24. The winch of claim 22, wherein:

the external casing further includes a fairlead which helps support the cable when released and retrieved from the spool.

25. The winch of claim 22, wherein:

the external casing including a stabilizing bar placed between ends of the first side wall and second side wall.

26. The winch of claim 21, further comprising:

a pull-start having a handle attached to a starter string, the starter string being fed into a starter casing and connected to a rotatable starter wheel.

27. The winch of claim 21, wherein:

the spool connects with the gear assembly through the first connecting gear communicating with a middle connecting gear which in turn connects to an end drive gear which is attached to the spool; and the end drive gear having a diameter larger than the first connecting gear and middle connecting gear.

28. The winch of claim 21, wherein:

the first connecting gear, middle connecting gear and end drive gear are protected through use of a rigid casing.

29. The winch of claim 21, wherein:

the gear assembly includes at least one planetary gear and at least one threaded ring.

30. The winch of claim 29, wherein:

each of said at least one planetary gear has a plurality of planet gears able to fit into a recess within each respective of said at least one threaded ring and receiving an end of the transmission drive.

31. The winch of claim 30, wherein:

the gear assembly also includes a first mounting plate and a second mounting plate to help maintain the planetary gear and threaded ring.

* * * * *